United States Patent [19]

Murakami et al.

[11] 4,439,711

[45] Mar. 27, 1984

[54] METAL VAPOR DISCHARGE LAMP

[75] Inventors: Katsuo Murakami; Isao Shoda; Hitoshi Kodama; Shoji Orikasa; Hiroshi Ito, all of Kanagawa, Japan

[73] Assignee: Mitsubishi Denki Kabushiki Kaisha, Tokyo, Japan

[21] Appl. No.: 196,484

[22] PCT Filed: Dec. 27, 1979

[86] PCT No.: PCT/JP79/00327

§ 371 Date: Aug. 27, 1980

§ 102(e) Date: Aug. 27, 1980

[87] PCT Pub. No.: WO80/01436

PCT Pub. Date: Jul. 10, 1980

[30] Foreign Application Priority Data

| | | | |
|---|---|---|---|
| Dec. 28, 1978 | [JP] | Japan | 53-166080 |
| Dec. 28, 1978 | [JP] | Japan | 53-166081 |
| Dec. 28, 1978 | [JP] | Japan | 53-166083 |
| Dec. 28, 1978 | [JP] | Japan | 53-166082 |

[51] Int. Cl.[3] ..... H01J 61/20; H01J 61/44

[52] U.S. Cl. ..... 313/487; 313/639

[58] Field of Search ..... 313/486, 487, 229, 220

[56] References Cited

U.S. PATENT DOCUMENTS

| | | | |
|---|---|---|---|
| 3,555,336 | 1/1971 | Koedam et al. | 313/486 |
| 3,569,762 | 3/1971 | Levine et al. | 313/486 |
| 3,825,792 | 7/1974 | Rokosz et al. | 313/487 |
| 4,049,992 | 9/1977 | Verstegen et al. | 313/486 |

FOREIGN PATENT DOCUMENTS

| | | |
|---|---|---|
| 431409 | 8/1935 | United Kingdom . |
| 495632 | 12/1938 | United Kingdom . |
| 523235 | 7/1940 | United Kingdom . |
| 840809 | 7/1960 | United Kingdom . |
| 852783 | 11/1960 | United Kingdom . |
| 1366940 | 9/1974 | United Kingdom . |
| 1466588 | 3/1977 | United Kingdom . |

*Primary Examiner*—Palmer C. Demeo

*Attorney, Agent, or Firm*—Oblon, Fisher, Spivak, McClelland & Maier

[57] ABSTRACT

A meal vapor discharge lamp having an outer jacket, the inside wall of which is covered by a fluorescent layer comprising at least one red emitting phosphor whose emission peak is in a wavelength range of 610–630 nm and whose luminescence forms a line, said lamp containing an arc tube within the confines of said outer jacket which encloses zinc and/or cadmium in addition to mercury as the main luminous components.

9 Claims, 17 Drawing Figures

METAL VAPOR DISCHARGE LAMP

FIELD OF THE INVENTION

The present invention relates to a metal vapor discharge lamp with high color-rendering properties.

BACKGROUND OF THE INVENTION

At present, the high-pressure mercury vapor discharge lamp is very useful as a highly reliable light source which has high efficiency and long lifetime characteristics. However, the color-rendering properties of the high-pressure mercury lamp are as poor as approximately 23 in the general color rendering index Ra. (FIG. 1 shows the spectral distribution of this high-pressure mercury vapor discharge lamp). Its usage has therefore been limited to exterior lighting and similar purposes. In order to enhance its color-rendering properties while maintaining its high efficiency and long life characteristics, the so-called fluorescent high-pressure mercury vapor discharge lamp was introduced and put into practical use. In this type of lamp the inside wall of its outer jacket is coated with a layer of a red emitting phosphor, comprising, for example, yttrium vanadate activated by europium. The color-rendering properties of the lamp have been gradually enhanced by improvement of the phosphor and related applied technology, but phosphor improvement alone has achieved only a rather poor general color rendering index value of approximately 53. (FIG. 2 shows the general spectral distribution of this type of fluorescent, high-pressure mercury vapor discharge lamp.) Another attempt to improve the color-rendering properties of the high-pressure mercury discharge lamp was made in the past, as an alternative to the above-mentioned use of phosphors in the lamp. In the alternative technique some additional metals were enclosed in the arc tube besides mercury such as cadmium and zinc so that the emission spectrum resulting from the discharge of the vapor of such metals would add to that from the mercury vapor discharge to improve the overall color-rendering properties of the lamp. However, it has been found, as discussed in the book edited by Elenbaas (W. Elenbaas, editor, "High Pressure Mercury Vapor Lamps and Their Applications", 1965, p. 294) that the problem with such lamps is, if a satisfactory emission spectrum is to be obtained by vapor discharge of cadmium or zinc, the vapor pressure level of such a metal must be raised, and the only way to do this is to set the designed temperature at the wall of the arc tube substantially high, and the wall loading of the arc tube higher than before. Since the arc tube must be made of silica, the arc tube at high temperature is susceptible to erosion by cadmium or zinc vapor, until the tube eventually cracks or is otherwise damaged which quite substantially shortens the life of the discharge lamp. In view of these facts, the present inventors for a time focussed attention on the color rendering property alone, and experimented by adding cadmium or zinc to the arc tube in attempts to fabricate a high-pressure vapor discharge lamp, which failed to show satisfactory color-rendering property with a general color rendering index of approximately 60. (FIG. 3 shows the spectral distribution of the high-pressure mercury vapor discharge lamp enclosing cadmium.) Moreover, because the load to be borne by its arc tube rose to a level of more than 50 percent above the conventional high-pressure mercury vapor discharge lamp, its arc tube broke down after approximately 1,000 hours had lapsed.

Another method to improve color-rendering property is to utilize the so-called metal halide discharge lamp, in whose arc tube the halides of various metals are additionally enclosed so as to obtain high vapor pressure without increasing tube wall temperature substantially. While good color rendition is now secured by the metal halide lamp, its weaknesses is its incapability of being lit by ordinary type ballasts for high pressure mercury vapor discharge lamps, because the starting voltage is higher than that of the conventional mercury lamp, because of the fact that it cannot use electrodes with an alkaline earth metal oxide electron emitter whose feature is good electron emissivity and that impure gases are likely to be admitted into the arc tube when the halide is enclosed in the tube. As a result, the metal halide lamp requires for its starting a specially designed ballast, which is large, heavy and expensive, all of which are defects which hamper its wide use.

DISCLOSURE OF THE INVENTION

Accordingly, one object of the invention is to provide a metal vapor discharge lamp of improved color-rendering properties which can be operated by a ballast for the high-pressure mercury vapor discharge lamp, by use of a fluorescent layer applied to the inside wall of the outer jacket of the lamp, which always comprises a red emitting phosphor or phosphors whose emission peak is in a wavelength range between 610 nm and 630 nm, and by means of an arc tube enclosing zinc and/or cadmium in addition to mercury, so that the light emission spectrum resulting from the metallic vapor discharge of the enclosed zinc and/or cadmium, on one side, and the luminescence of the phosphor, on the other, interact to generate multiplied effects.

Another object of the invention is to provide a metal vapor discharge lamp of improved color-rendering properties substantially without adversely affecting the characteristics of the lamp including acceleration of arc tube blackening, which can be operated by a ballast for the high-pressure mercury vapor discharge lamp, by use of a fluorescent layer being applied to the inside wall of the outer jacket, said layer always comprising a red emitting phosphor or phosphors whose emission peak is in a wavelength range between 610 nm and 630 nm, and by means of an arc tube enclosing zinc and/or cadmium in addition to mercury, the share of the total enclosed content of zinc and/or cadmium, based on the total amount of enclosed metal including mercury, being between 0.1 and 50 weight percent, so that a light emission spectrum generated by the metallic vapor discharge of the enclosed zinc and/or cadmium, on one side, and the luminescence of the phosphor, on the other, interact to generate multiplied effects.

Still another object of the invention is to provide a metal vapor discharge lamp able to minimize the failure of conventional discharge lamps which is caused by a drop of the lumen maintenance factor during its lifetime or by a broken arc tube, or some other reason, by sealing a halide in an amount of $0.7\times10^{-6}$ gr-atom or less per cubic centimeter of the inner volume of the arc tube in the arc tube. In the case of a metal vapor discharge lamp, the color-rendering property can be substantially improved and the lamp can be operated by a ballast for a high-pressure mercury vapor discharge lamp, by use of a fluorescent layer, being applied to the inside wall of outer jacket, which always comprises a red emitting phosphor or phosphors whose emission peak is in a wavelength range between 610 nm and 630 nm, and by means of an arc tube enclosing zinc and/or cadmium in addition to mercury.

Yet another object of the invention is to provide a metal vapor discharge lamp of substantially improved color-rendering property and secured stable characteristics, which can be operated by a ballast for a high pressure mercury vapor discharge lamp by use of a fluorescent layer being applied to the inside wall of the outer jacket, and always comprising a red emitting phosphor or phosphors whose emission peak is in a wavelength range between 610 nm and 630 nm, and by means of an arc tube enclosing zinc and/or cadmium in addition to mercury, the enclosed contents being specified for the mercury and for the zinc and/or cadmium, with the wall loading of the arc tube also being specified, so that a light emission spectrum generated by the metallic vapor discharge of the enclosed zinc and/or cadmium, on one side, and the luminescence of the phosphor, on the other, interact to generate multiplied effects.

THE PREFERRED EMBODIMENT OF THE INVENTION

Figure 4:
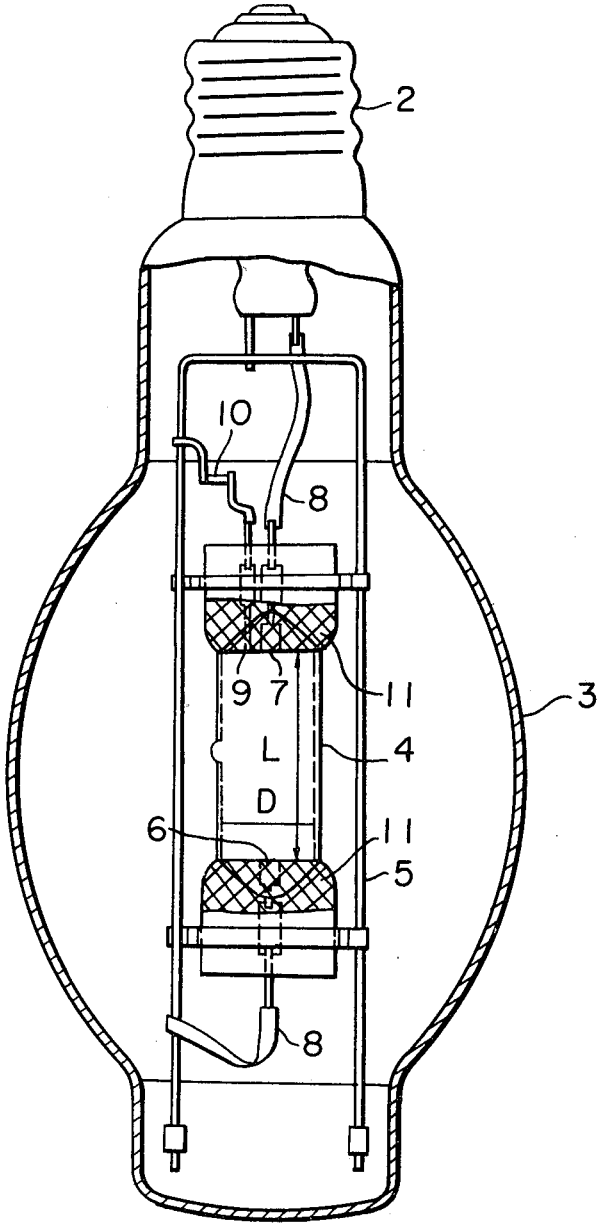
FIG. 4 is a structural drawing which illustrates an embodiment of the discharge lamp of the present invention.

Referring now to FIG. 4, the same is a structural drawing of an embodiment of the metal vapor discharge lamp of the present invention, wherein the outer jacket 1, eggplant-shaped, and made of transparent glass which allows light to pass through it, has a metal base 2 on one of its ends. The inside wall of the outer jacket is coated with a fluorescent layer 3 comprising a phosphor or phosphors always including a red emitting phosphor or phosphors with a coating weight of approximately $0.4\sim4$ mg/cm$^2$, whose emission peak is in a wavelength range between 610 nm and 630 nm, and whose luminescence forms a line. The arc tube 4 is supported and fixed by supporting members 5 provided in said outer jacket 1, and encloses zinc and/or cadmium, in addition to mercury and rare gases. The electrodes 6 and 7 are attached to and sealed into both ends of said arc tube 4, and are electrically connected to said metal base 2 through the medium of said supporting members 5 or of the ribbon lead 8. The starting electrode 9 is attached to and sealed into the arc tube at a point near one electrode 6 of the pair. Symbol 10 represents the starting resistor. The heat-insulating film 11 is made from platinum, zirconia or the like applied to the end part of the arc tube 4. The presence of the heat-insulating film 11, which serves the purpose of controlling the vapor pressure of the enclosed metals, is not mandatory, depending upon the shape of the arc tube and the level of input power.

Figure 5:
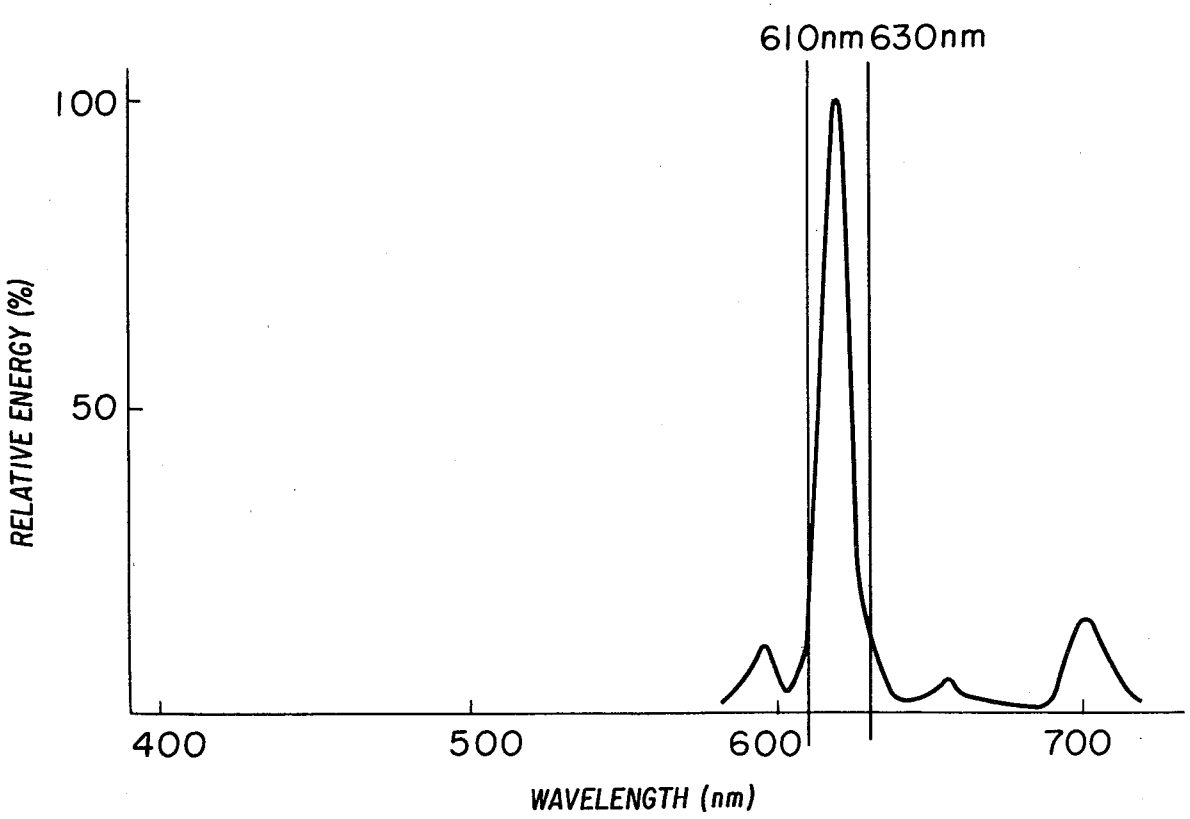
FIG. 5 illustrates the emission spectrum of the red emitting phosphor.

The phosphor applied to the inside wall of the outer jacket 1, is a red emitting phosphor or phosphors luminescing practically within a wavelength range of $610\sim630$ nm and in a line shape, because this secures the desired high level of color-rendering property. The use of phosphors that luminesce in a shorter wavelength region than 610 nm cannot secure good color rendition, while the use of those which luminesce in a longer wavelength region than 630 nm leads to a drop in luminous efficacy and color-rendering property. The material that can satisfy the requirements for such a phosphor is yttrium vanadate activated by trivalent europium which, as shown in FIG. 5, luminesces mainly in the wavelength range of $610\sim630$ nm and in a line shape, conditions that most suit the discharge lamp of the present invention. Without causing substantial changes in its emission spectrum, this phosphor allows improvement of lamp characteristics by substituting some part of the vanadium in its matrix crystals with other elements including phosphorus, arsenic, boron and silicon, and by replacing some part of the yttrium with other elements including gadolinium, zinc, cadmium, terbium and bismuth. Any phosphor obtained by replacement of a component with these elements can be used as satisfactorily as the vanadate phosphor mentioned above.

Furthermore, another type of phosphor suitable for use in the discharge lamp of the present invention is a mixture of said vanadate phosphor with a phosphor of magnesium fluoro-germanate activated by tetravalent manganese, a phosphor having its emission peak in the vicinity of approximately 660 nm. Notably and recommendably, very good color-rendition is attainable by a phosphor coated inside the outer jacket if it is a mixture of at least 50 weight-percent of vanadate phosphor and at most 50 weight percent of magnesium fluoro-germanate phosphor. In this case, the highest color-rendering property was observed when the share of the fluoro-germanate phosphor in the mixture is approximately 30 weight-percent, and the color-rendering property and luminous efficacy were found dropping after the share exceeds the 50 weight-percent level, so as to lose practical utility.

In the use of the vanadate phosphor activated by trivalent europium so that it functions as a red emitting phosphor radiating at a wavelength of $610\sim630$ nm and in a line shape, satisfactory color-rendering properties can be attained by mixing this phosphor with an orange emitting phosphor such as the phosphor of strontium-manganese phosphate activated by tin, or with a green emitting phosphor such as the phosphor of yttrium silicate activated by cerium and terbium or by terbium, that of aluminate activated by cerium and terbium, and that of barium-magnesium aluminate activated by europium and manganese, or with a blue emitting phosphor such as the phosphor of strontium chlorophosphate activated by europium, or barium-magnesium aluminate activated by europium. In these cases, it is recommended that the share of the vanadate phosphor activated by trivalent europium in the total weight of all the phosphors should be at least approximately 50 weight-percent in effect, because an amount of the vanadate less than 50 weight-percent will result in deterioration of the color-rendering property, and the colors will be sensed as not natural by the eye.

The mechanism by which the present discharge lamp works is as follows: First, electric power supply voltage fills the ballast. Then, voltage generated by the ballast fills the arc tube which causes a discharge between one electrode 6 and the starting electrode 9. This proceeds to the main discharge between both electrodes 6 and 7. As the main discharge starts, the enclosed zinc and/or cadmium as well as mercury evaporate totally or in part, and each radiates light specific to the individual kinds of the metals. Zinc vapor radiates line spectra having principal wavelengths of 328 nm, 330 nm, 335 nm, 468 nm, 472 nm, 481 nm and 636 nm. Cadmium vapor radiates line spectra having principal wavelengths of 326 nm, 340 nm, 347 nm, 361 nm, 468 nm, 480 nm, 509 nm and 644 nm. Mercury vapor radiates line spectra having principal wavelengths of 254 nm, 313 nm, 365 nm, 405 nm, 436 nm, 492 nm, 546 nm and 578 nm. The ultra-violet region of the total radiation is absorbed by phosphor 3 which is deposited on the inside wall of the outer jacket 1, and is converted to a red light having an emission peak in the wavelength range of 610~630 nm and radiates in a line shape. Meanwhile, most of the visible radiation passes through the layer of the phosphor 3 without being absorbed by the phosphor. The appropriate mixture of such passed light and the light radiated from phosphor gives a discharge lamp having a satisfactory color-rendering property.

Examples embodying the present invention will be described below.

EXAMPLE 1

An arc tube 4 was prepared by providing a quartz tube having an inside diameter of 9.2 mm and a distance between the electrodes 6 and 7 of 31 mm, and enclosing 15.5 mg mercury and 2.2 mg cadmium, and further enclosing argon gas at 35 torr. Finally, the tube was sealed to complete an arc tube having a power input of 100 W. On the inside wall of the outer jacket 1, a fluorescent layer 3 was formed, by applying to the wall a mixture of 70 weight-percent yttrium phosphate-vanadate phosphor activated by trivalent europium, and 30 weight-percent magnesium fluoro-germanate phosphor activated by tetravalent manganese, and by taking the mixture. The arc tube 4 thus prepared was placed in the outer jacket, and the bulb was deaerated to complete the metal vapor discharge lamp of 100 W having the construction as shown in FIG. 4.

The metal vapor discharge lamp thus completed was operated by a choke-type ballast for a 100 W high-pressure mercury lamp, the ballast having a rated voltage of 200 V, entailing that the starting voltage was 100 V, a level even lower than approximately 130 V which is required for the conventional 100 W high-pressure mercury lamp, so that the metal vapor discharge lamp was capable of being operated by a ballast for a high-pressure mercury lamp. The lamp had a color temperature of 4800° K., a general color-rendering index of Ra 94 which is a very high color-rendering property level, a luminous efficacy of 37 lm/W, and a wall loading on the arc tube of 11.2 W/cm$^2$.

EXAMPLE 2

A 100 W metal vapor discharge lamp was completed according to the method of Example 1 above, except that the arc tube 4 was prepared by providing a quartz tube having an inside diameter of 9.2 mm and a distance between electrodes 6 and 7 of 28 mm. The tube enclosed 16.7 mg mercury (Hg) and 1.41 mg zinc (Zn) and 35 torr argon gas, and was sealed to complete an arc tube having a power input of 100 W. This metal vapor discharge lamp had a starting voltage of 102 V, and could be operated by a ballast for a 100 W high-pressure mercury lamp. The operated lamp had a color temperature of 4700° K., a general color rendering index Ra 80, which is a high color rendition level, a luminous efficacy of 35 lm/W, and a wall loading of the arc tube of 12.4 W/cm$^2$.

Figure 6:
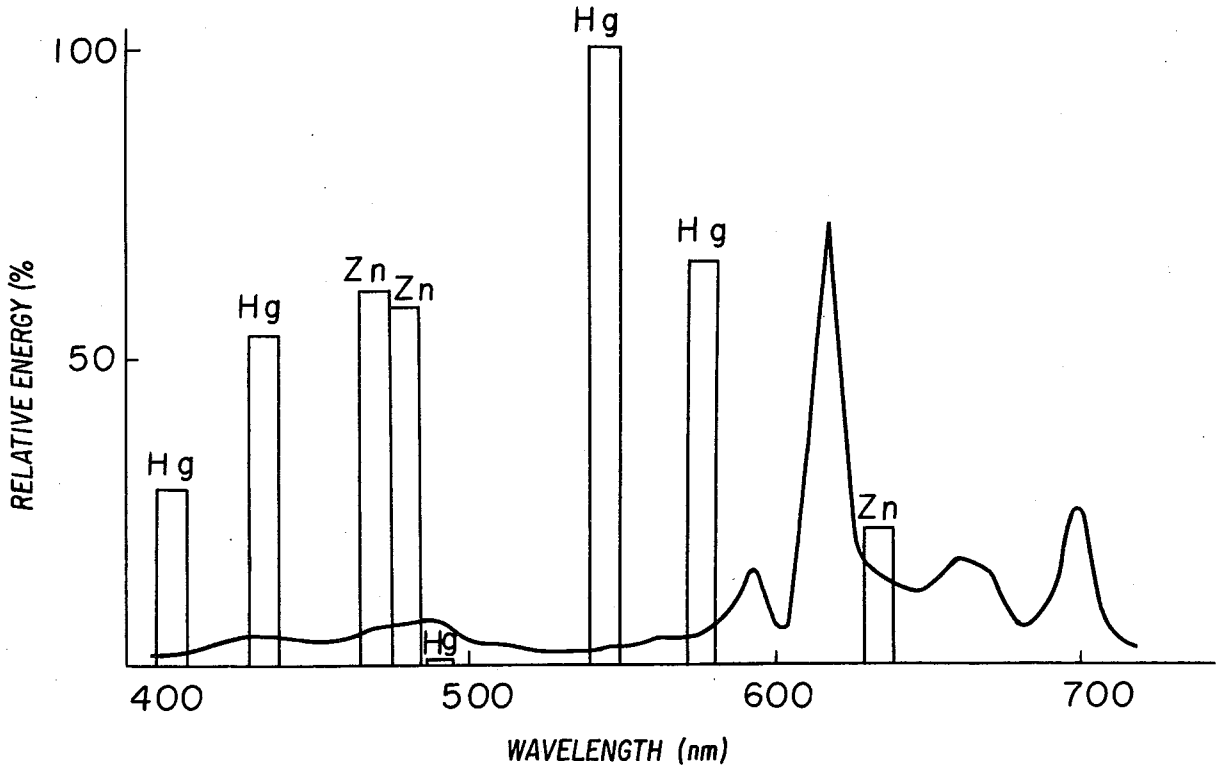
FIGS. 6 and 7 illustrate the spectral distribution of the discharge lamps of Examples 2 and 4 of the present invention.

FIG. 6 shows the spectral distribution of this metal vapor discharge lamp. The line spectrum symbols Hg and Zn in the figure represent the line spectra generated by mercury (Hg) and cadmium (Cd) vapors, respectively.

EXAMPLE 3

An arc tube 4 was prepared from a quartz tube having an inside diameter of 19.5 mm, and a distance between electrodes 6 and 7 of 70 mm. 59.2 mg of mercury and 0.845 mg cadmium were enclosed followed by argon gas at 20 torr. Finally, the tube was sealed to complete an arc tube having an input power of 400 W. On the inside wall of the outer jacket 1, a mixture of 70 weight-percent yttrium phosphate-vanadate phosphor activated by trivalent europium, and 30 weight-percent magnesium fluoro-germanate phosphor activated by tetravalent manganese, and by baking the mixture. The arc tube 4 thus prepared was placed in the outer jacket, and the bulb was deaerated to complete a metal vapor discharge lamp of 400 W having the construction shown in FIG. 4.

The metal vapor discharge lamp thus completed was operated by a choke-type ballast for a 400 W high-pressure mercury lamp, the ballast having a rated voltage of 200 V, meaning that the starting voltage was 98 V, a level even lower than approximately 130 V which is required for the conventional 400 W high-pressure mercury lamp, so that the metal vapor discharge lamp was capable of being operated by a ballast for a high-pressure mercury lamp. The lamp had a color temperature of 4100° K., a general color rending index Ra 86 which is a high color rendition level, a luminous efficacy of 56 lm/W, and a wall loading of the art tube of 9.38 W/cm$^2$.

EXAMPLE 4

Figure 7:
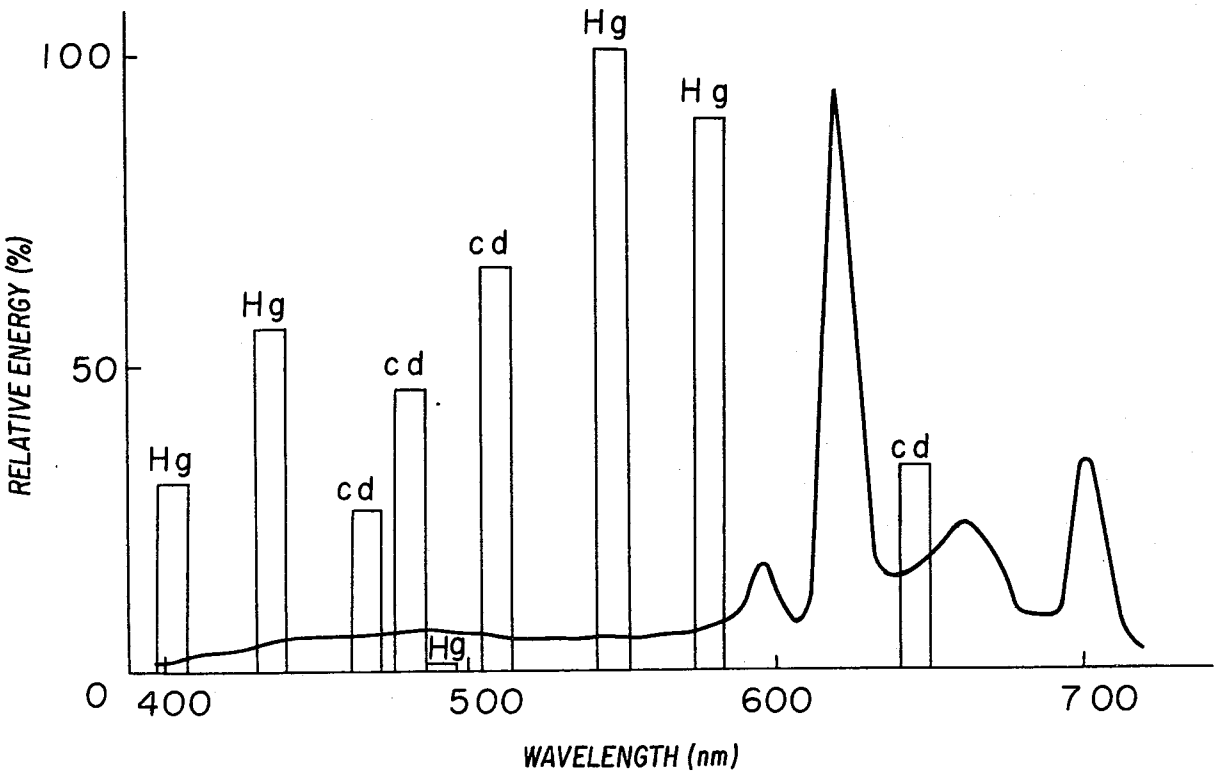

A 400 W metal vapor discharge lamp was completed according to the method of Example 3 above, except that the amount of mercury enclosed in the art tube 4 was 59.O mg, and that of cadmium so enclosed was 7.9 mg. This discharge lamp had a starting voltage of 100 V, and could be operated by a ballast for a 400 W high-pressure mercury discharge lamp. It had a color temperature of 4300° K., and a general color rendering index Ra 95 which is a high color rendition level, a luminous efficacy of 56 m/W, and a wall loading of the arc tube of 9.33 W/cm$^2$. FIG. 7 shows the spectral distribution of this metal vapor discharge lamp. The line spectrum symbols Hg and Cd in the figure represent the line spectra generated by mercury (Hg) and cadmium (Cd) vapors, respectively.

EXAMPLE 5

A 400 W metal vapor discharge lamp was completed according to the method of Example 3 above, except that the arc tube 4 was a quartz tube having an inside diameter of 19.5 mm, and a distance between the electrodes 6 and 7 of 55 mm, and that, after enclosing 75.1 mg mercury and 6.33 mg zinc, and then enclosing 20 torr argon gas in the arc tube, the tube was sealed to complete an arc tube having a power input of 400 W. This discharge lamp had a starting voltage of 95 V, and could be operated by a ballast for a 400 W high-pressure mercury lamp. It had a color temperature of 4400° K., and a general color rendering index Ra 71 which is a high color rendition level, a luminous efficacy of 55 lm/W, and a wall loading of the arc tube of 11.9 W/cm$^2$.

EXAMPLE 6

A 400 W high-pressure mercury vapor discharge lamp was completed according to the method of Example 3 above, except that the fluorescent layer formed on the inside wall of the outer jacket 1 was only a phosphor of yttrium vanadate activated by trivalent europium. This metal vapor discharge lamp had a starting voltage of 98 V, and could be operated by a ballast for a 400 W high-pressure mercury lamp. It had a color temperature of 4000° K., a general color rendering index, Ra 84, which is a high color rendition level, a luminous efficacy of 57 lm/W, and a wall loading of the arc tube of 9.33 W/cm$^2$.

EXAMPLE 7

A 400 W high-pressure metal vapor discharge lamp was completed according to the method of Example 3 above, except that the amount of mercury enclosed in the arc tube 4 was 59.2 mg, that of zinc was 3.1 mg, and that of cadmium was 1.52 mg. This metal vapor discharge lamp had a starting voltage of 99 V, and could be operated by a ballast for a 400 W high-pressure mercury lamp. It had a color temperature of 4200° K., a general color rendering index, Ra 88, which is a high color rendition level, a luminous efficacy of 56 lm/W, and a wall loading of the arc tube of 9.33 W/cm$^2$.

Table 1 shows the lamp characteristics of all the above example lamps as well as those of the conventional high pressure mercury lamp, a fluorescent high-pressure mercury lamp, an experimental high-pressure mercury lamp with enclosed cadmium, and an experimental high-pressure mercury lamp with enclosed zinc.

TABLE 1

| | Metal enclosed | | | | Starting | | | Color | Luminous | Wall loading |
|---|---|---|---|---|---|---|---|---|---|---|
| | Hg (mg) | Zn (mg) | Cd (mg) | Phosphor | Voltage (V) | Ballast type | Ra | temp. (°K.) | efficacy (lm/W) | of Arc tube (W/cm$^2$) |
| High-pressure Hg vapor discharge lamp | 70 | | | None | 130 | Ballast for 400W high-pressure Hg lamp | 23 | 5900 | 52.5 | 9.33 |
| Fluorescent high-pressure Hg lamp | 70 | | | Provided | 130 | Same | 53 | 4100 | 60.0 | 9.33 |
| Experimental Cd-enclosed high-pressure Hg lamp | 60 | | 10 | None | 100 | Same | 62 | 7250 | 42.5 | 17.8 |
| Experimental Zn-enclosed high-pressure Hg lamp | 65 | 8 | | None | 100 | Same | 49 | 6500 | 38.0 | 19.2 |
| Example 1 | 15.5 | | 2.2 | Provided | 100 | Ballast for 100W high-pressure Hg lamp | 94 | 4800 | 37 | 11.2 |
| Example 2 | 16.7 | 14.1 | | Provided | 102 | Same | 80 | 4700 | 35 | 12.4 |
| Example 3 | 59.2 | | 0.845 | Provided | 98 | Ballast for 400W high-pressure Hg lamp | 86 | 4100 | 56 | 9.33 |
| Example 4 | 59.0 | | 7.9 | Provided | 100 | Same | 95 | 4300 | 56 | 9.33 |
| Example 5 | 75.1 | 6.33 | | Provided | 95 | Same | 71 | 4400 | 55 | 11.9 |
| Example 6 | 59.2 | | 0.845 | Provided | 98 | Same | 84 | 4000 | 57 | 9.33 |
| Example 7 | 59.2 | 3.1 | 1.52 | Provided | 99 | Same | 88 | 4200 | 56 | 9.33 |

Table 1 clearly shows that all the metal vapor discharge lamps of the examples in the table embodying the present invention are capable of being operated by a ballast for high-pressure mercury vapor discharge lamps, and moreover, that they have a substantially enhanced color-rendering property level, as compared with the conventional lamps including high-pressure mercury lamps, fluorescent high-pressure mercury lamps, an experimental cadmium-enclosed high-pressure mercury lamp, and an experimental zinc-enclosed high-pressure mercury lamp.

Figure 8:
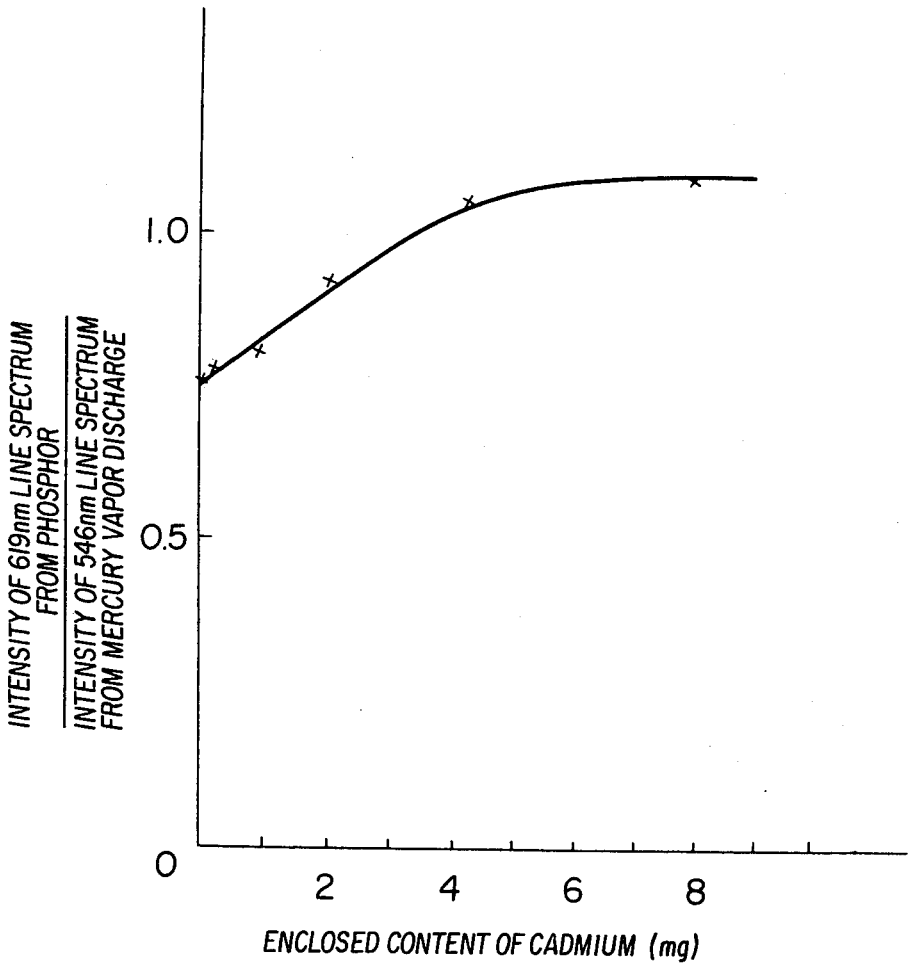
FIG. 8 illustrates the enclosed content of cadmium correlated with the ratio of the line spectrum intensitites of 546 nm generated by mercury to the line spectrum intensities at 619 nm generated by a phosphor.

It can be presumed that the substantial enhancement in color-rendering property observed in the foregoing examples embodying the present invention are due to the following reasons: The enclosed cadmium or zinc in the arc tube 4 causes the discharge through its vapor to generate an emission spectrum which principally supplements blue-green radiation, while the luminescence from the fluorescent layer mainly supplements red radiation, thus improving the color-rendering property of the lamp. The color rendition improvement is not only additive but also multiplicative of both kinds of radiation, because of the multiplied effects induced by this, by increasing the ratio of the 619 nm emission spectrum from the fluorescent layer to the 546 nm emission spectrum from the mercury vapor discharge, as such an increase contributes to improvement in the color-rendering property. This is confirmed by FIG. 8 which illustrates the ratio of 619 nm line spectrum intensity to 546 nm line spectrum intensity as a function of the enclosed amount of cadmium, as tested about a 400 W discharge lamp, proving that the enclosure of more cadmium increases the ratio between the intensities. The fact that the radiation output of the 619 nm line spectrum emitted from a phosphor is enhanced by enclosure of cadmium or zinc may be interpreted as reflecting the improving relationship of the output and wavelength of ultra-violet radiation from the metal vapor discharge to the excited spectrum of the phosphor.

Figure 1:
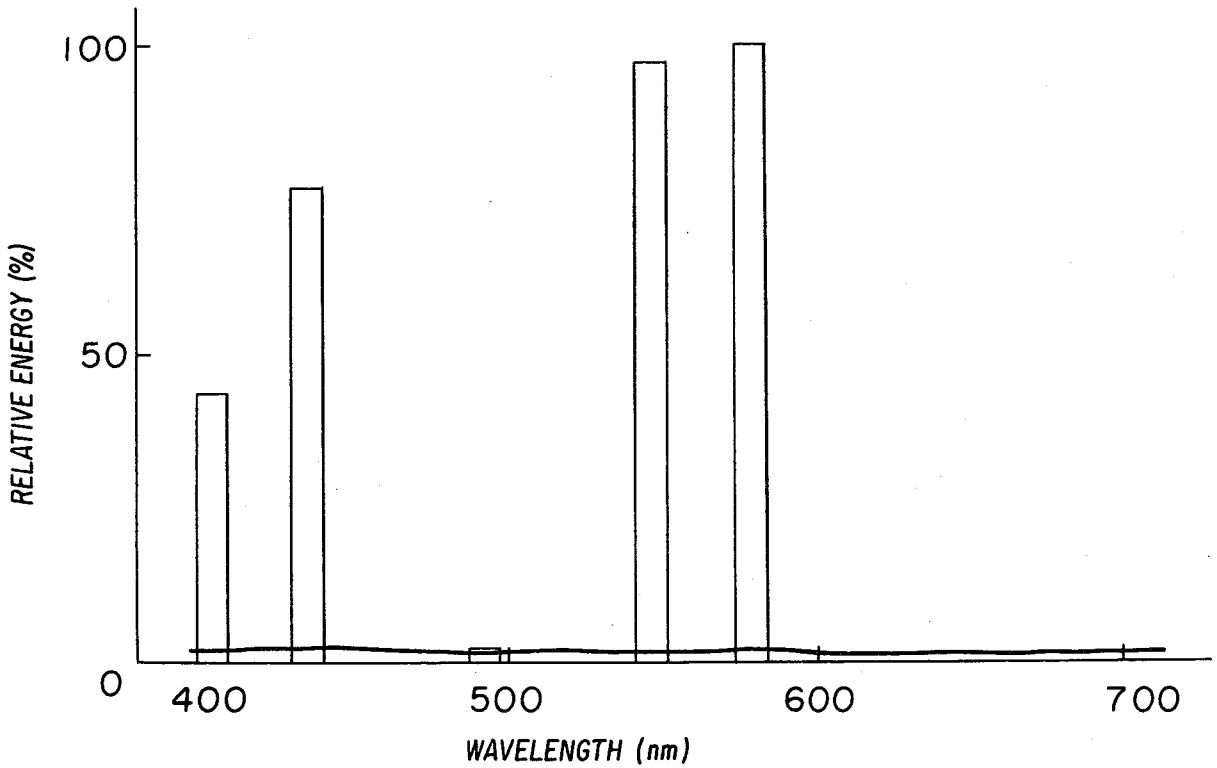
FIGS. 1, 2 and 3 illustrate the spectral distributions for the high-pressure mercury vapor discharge lamp, the fluorescent high-pressure mercury vapor discharge lamp, and the high-pressure mercury vapor discharge lamp containing cadmium, respectively.
Figure 2:
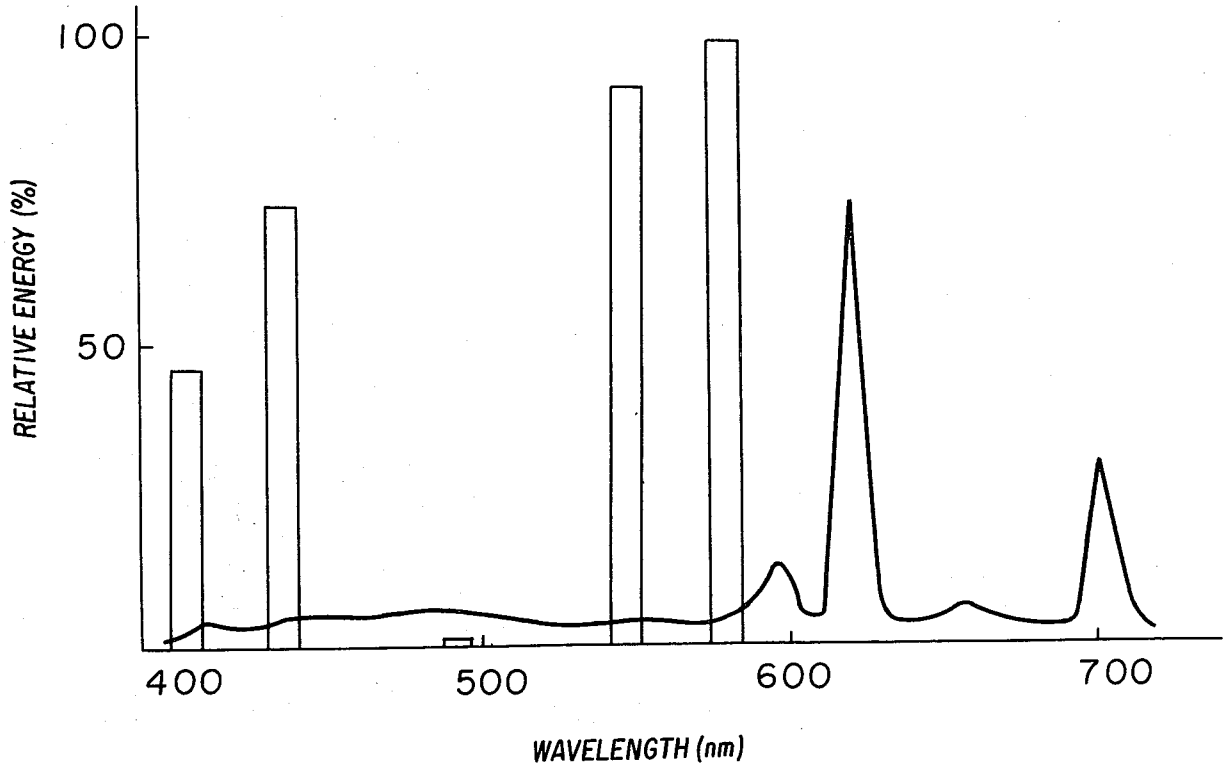
Figure 3:
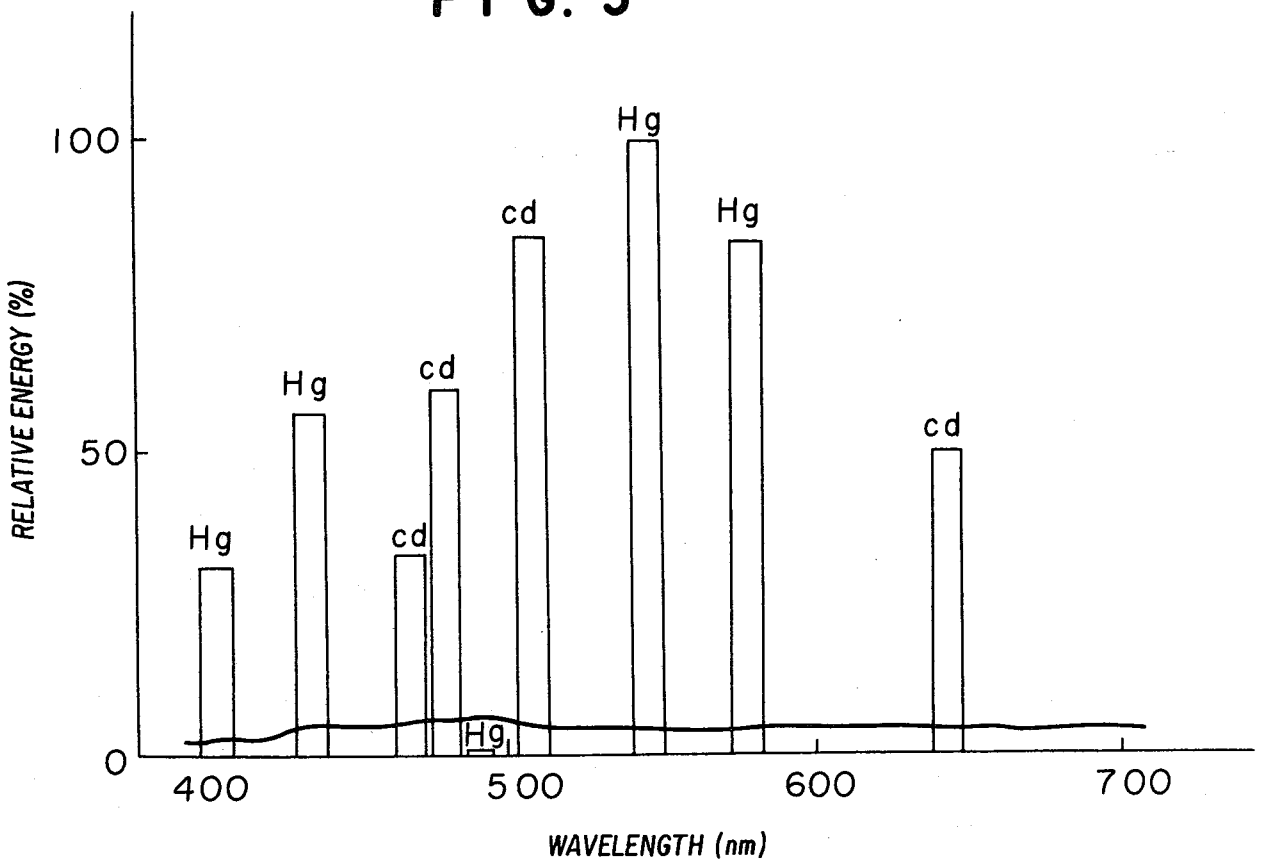

The spectral distribution in FIG. 3 for a cadmium-enclosed high-pressure mercury vapor discharge lamp can be compared with that in FIG. 7 for the lamp of Example 4. The lamp of Example 4 can subdue the intensity of the line spectrum from cadmium so low that the wall loading of the arc tube can be limited to a low level and therefore the load level for all the exemplary embodiments in this table are within the range of 9~12.5 W/cm$^2$, which is roughly the same level as that of the conventional high-pressure mercury lamps (7~13 W/cm$^2$ in general). This increases the durability of the arc tube 4 which increases the life of the metal vapor discharge lamps.

Figure 9:
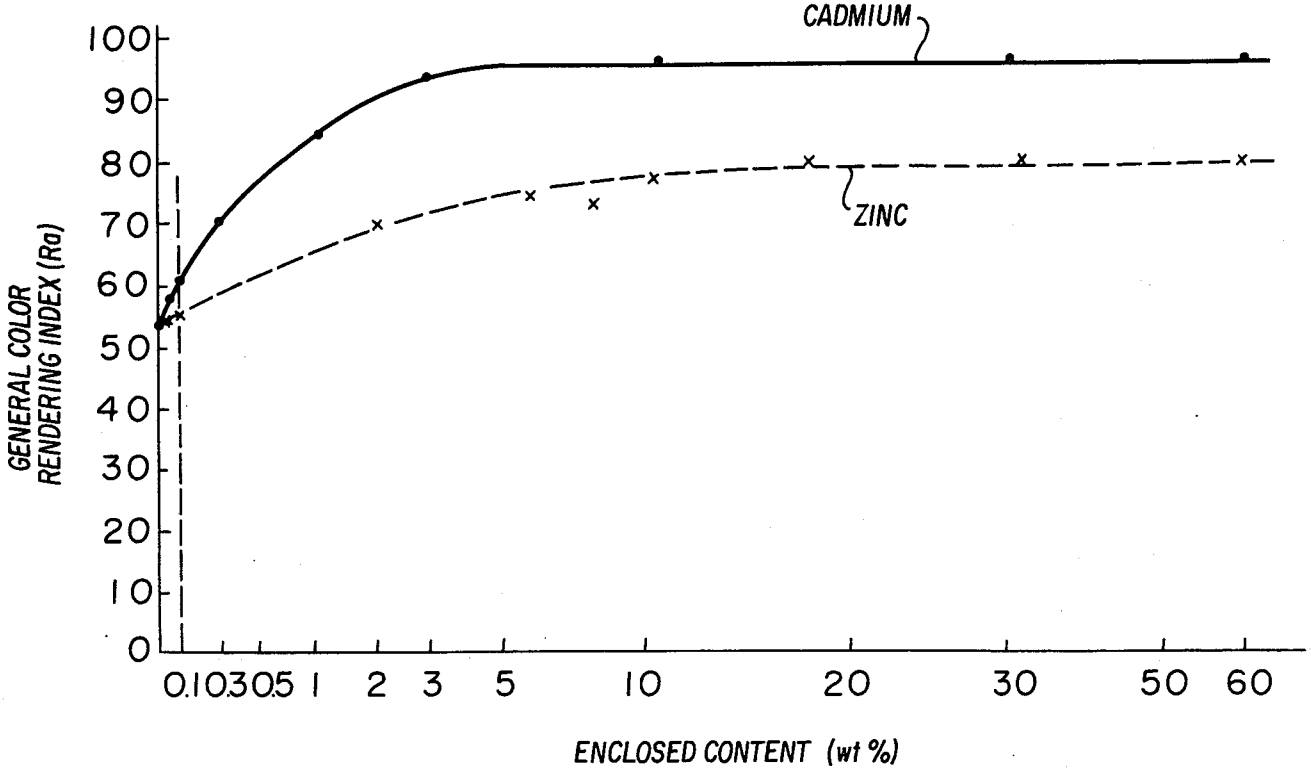
FIG. 9 illustrates the relation between the enclosed contents of zinc or cadmium and the general color rendering index Ra.

The requirement for accomplishing the second object of the present invention is that the total content of zinc and/or cadmium, in admixture with mercury is between 0.1 and 50 weight-percent. This requirement was determined as follows. FIG. 4 illustrates the structure of a discharge lamp whose outer jacket 1 has an inside wall coated with a phosphor mixture, comprising 70 weight-percent of yttrium vanadate phosphor activated by europium, and 30 weight-percent of magnesium fluoro-germanate phosphor activated by tetravalent manganese. The lamp uses the arc tube 4 made of quartz tube having an inside diameter of 19.5 mm, and a distance between the electrodes 6 and 7 of 68 mm. The general color rendering index Ra was measured for the FIG. 4 lamp as a function of the amounts of the enclosed cadmium and zinc, as illustrated in FIG. 9. FIG. 9 clearly indicates favorable effects for improving color-rendition when the enclosed content of the metal exceeds 0.1 weight-percent, depending on whether the metal is cadmium or zinc. Undesirable effects were observed when the share of the enclosed amount of zinc or cadmium exceeded 50 weight-percent, because these metals, the pressure of whose vapors is relatively low, increasingly tended to remain in the condensed state as a solid or liquid even while the lamp is burning. Such solid or liquid metal tends to deposit between the starting electrode 9 and the electrode 6 thereby inducing a shortcircuit, or stick to the wall of the arc tube 4 to accelerate the blackening of the tube. The amount of mercury to be enclosed in the arc tube 4, which is determined by a distance between the electrodes 6 and 7, the inside diameter of the arc tube 4, and the desired tube voltage and tube current characteristics, must usually be kept within a range of 0.5~20 mg per cubic centimeter of the unit inner volume of the arc tube 4. If the amount of mercury enclosed is below 0.5 mg/cc, the mercury vapor pressure will be so low that elongation of the arc tube 4 will be required to secure the desired lamp voltage, thereby sharply diminishing the efficiency of the lamp making it unuseful. If the amount exceeds 20 mg/cc, the pressure of mercury vapor will climb so high that an even higher pressure level will be required for the added metal. This will raise the load on the wall of the arc tube to 14 W/cm$^2$ or more, with the result that cracking of the arc tube 4 will be virtually ensured making such a lamp virtually unfeasible.

An exemplary embodiment for accomplishing the second object of the present invention is as follows.

EXAMPLE 8

Figure 10:
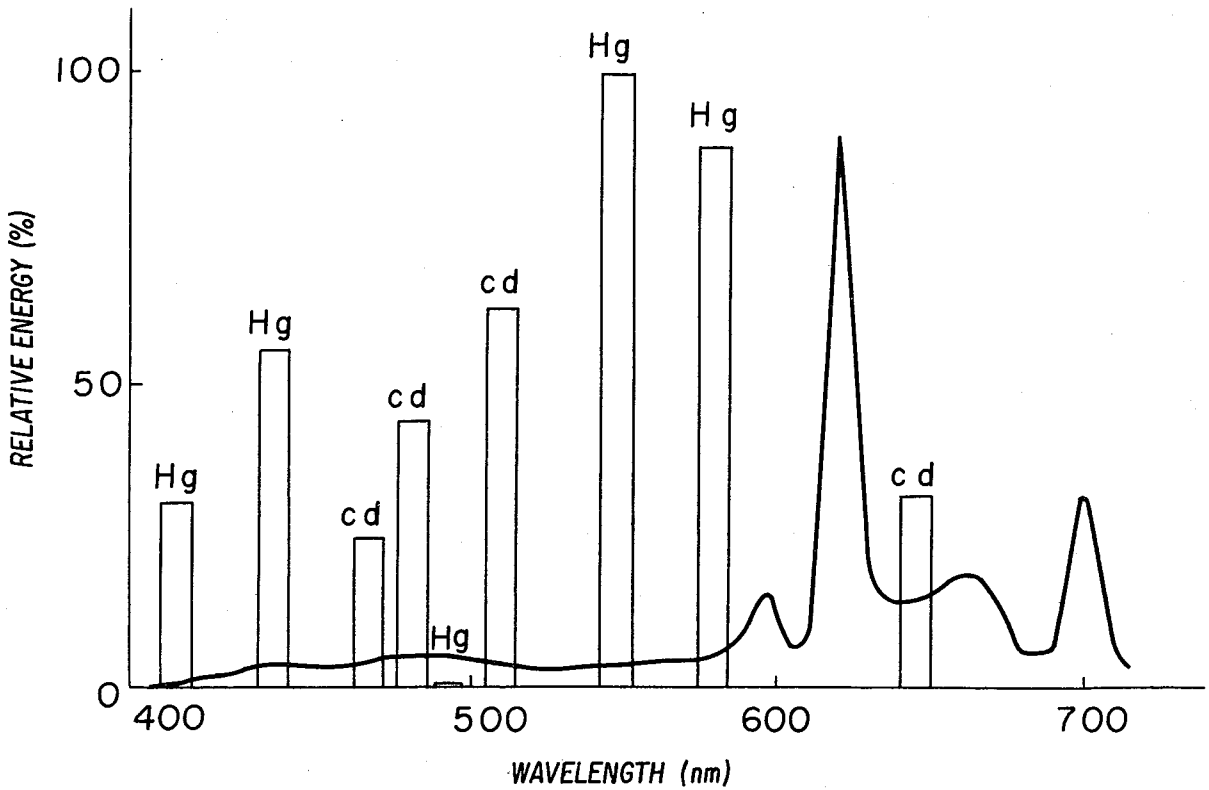
FIGS. 10 and 11 illustrate the spectral distribution of the discharge lamps in Examples 8 and 9 respectively, embodying the present invention.

The arc tube 4 was prepared by providing a quartz tube having an inside diameter of 19.5 mm, and a distance between electrodes of 6 and 7 of 68 mm, enclosing in the tube 61.0 mg (2.8 mg/cc) mercury and 1.89 mg (3.0 weight-percent enclosed content) cadmium, then further enclosing argon gas at 20 torr, and finally sealing the tube to complete the arc tube having a power input of 400 W. On the inside wall of the outer jacket 1, a fluorescent layer 3 was formed, by applying to the wall a mixture of 70 weight-percent yttrium phosphate-vanadate phosphor activated by trivalent europium, and 30 weight-percent magnesium fluoro-germanate phosphor activated by tetravalent manganese, and by baking the mixture. The arc tube 4 thus prepared was placed in the outer jacket 1, and the bulb was deaerated to complete a metal vapor discharge lamp of 400 W having the construction shown in FIG. 4. The metal vapor discharge lamp thus completed was operated by a choke-type ballast for a high-pressure mercury lamp, the ballast having a rated voltage of 200 V, entailing that the starting voltage was 99 V, a level even lower than approximately 130 V which is required for the conventional 400 W high-pressure mercury lamp, so that the metal vapor discharge lamp was capable of being operated by a ballast for a high-pressure mercury lamp. The lamp had a color temperature of 4200° K., a general color rendering index of Ra 93, which is a high color rendition level, a luminous efficacy of 57 lm/W, and a wall loading of the arc tube of 9.60 W/cm$^2$. FIG. 10 shows the spectral distribution of this metal vapor discharge lamp. The line spectrum symbols Hg and Cd in the figure represent the line spectra generated by mercury (Hg) and cadmium (Cd) vapors, respectively.

EXAMPLE 9

Figure 11:
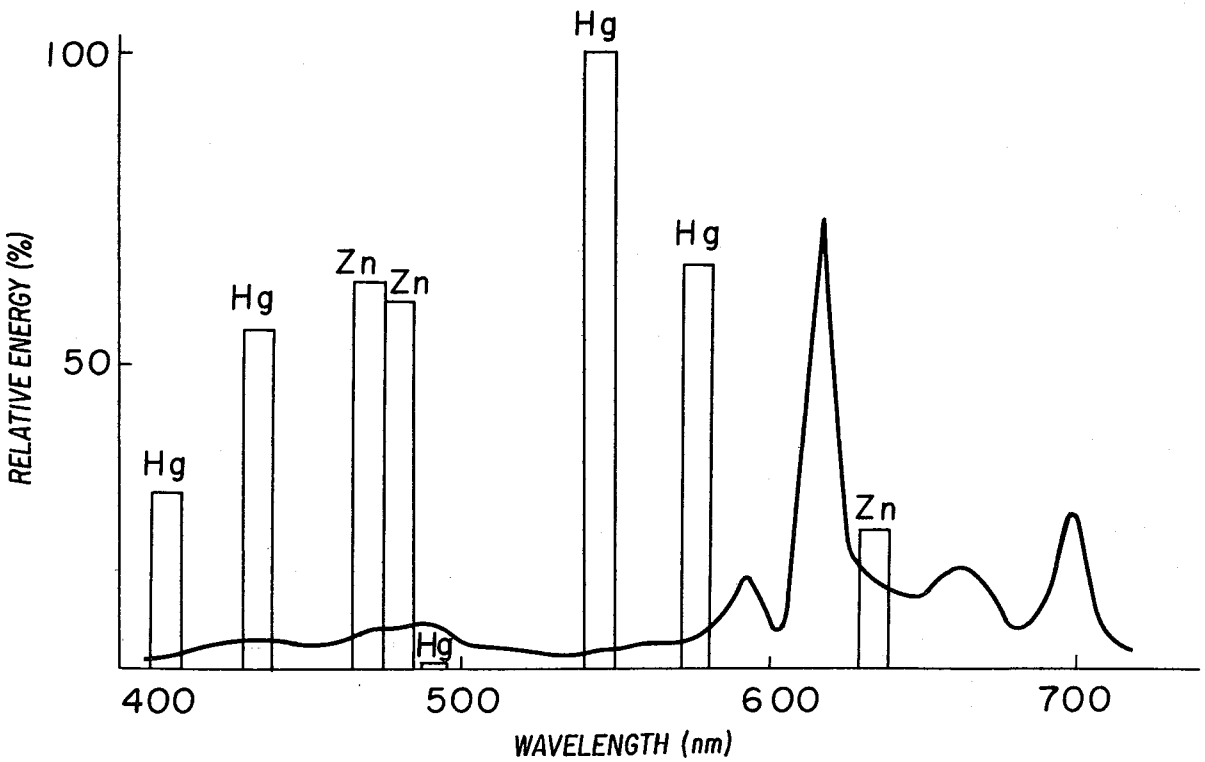

A 100 W metal vapor discharge lamp was completed according to the Example 8 method above, except that the arc tube 4 was a quartz tube having an inside diameter of 10.3 mm, and a distance between the electrodes 6 and 7 of 25 cm, and that, after enclosing 15.0 mg (6.8 mg/cc) mercury and 1.27 mg (7.8 weight-percent enclosed content) zinc, and then enclosing 35 torr argon gas in the arc tube, the tube was sealed to complete an arc tube having a power input of 100 W. This metal vapor discharge lamp had a starting voltage of 100 V which was even lower than the approximately 130 V for the conventional 100 W high-pressure mercury lamp. It could be operated by a choke-type ballast with a rated voltage of 200 V for a 100 W high-pressure mercury lamp. It had a color temperature of 4800° K., and a general color rendering index of Ra 80, which is a high color rendition level, a luminous efficacy of 36 lm/W, and a wall loading of the arc tube of 12.4 W/cm$^2$. FIG. 11 shows the spectral distribution of this metal vapor discharge lamp. The line spectrum symbols Hg and Zn in the figure represent the line spectra generated by mercury (Hg) and zinc (Zn) vapors, respectively.

sure mercury lamp, an experimental high-pressure mercury lamp with enclosed cadmium and an experimental high-pressure mercury lamp with enclosed zinc.

TABLE 2

| | | Metal Enclosed | | | Zn + Cd | | Starting Voltage | | | Color | Luminous | Arc Tube wall |
|---|---|---|---|---|---|---|---|---|---|---|---|---|
| | | Hg (mg) | Zn (mg) | Cd (mg) | Hg+Zn+Cd (wt. %) | Phosphor | (V) | Ballast type | Ra | temp. (°K.) | efficacy (lm/W) | loading of (W/cm²) |
| Conventional Lamp | High-pressure Hg vapor discharge lamp | 70 | | | | None | 130 | Ballast for 400W high pressure Hg lamp | 23 | 5900 | 52.5 | 9.33 |
| | Fluorescent high-pressure Hg lamp | 70 | | | | Provided | 130 | Same | 53 | 4100 | 60.0 | 9.33 |
| | Cd-enclosed high-pressure Hg lamp (trially fabricated) | 60 | | 10 | 14.3 | None | 100 | Same | 62 | 7250 | 42.5 | 17.8 |
| | Zn-enclosed high-pressure Hg lamp (trially fabricated) | 65 | 8 | | 11.0 | None | 100 | Same | 49 | 6500 | 38.0 | 19.2 |
| Examples embodying this invention | Example 8 | 61 | | 1.89 | 3.0 | Provided | 99 | Same | 93 | 4200 | 57.0 | 9.60 |
| | Example 9 | 15 | 1.27 | | 7.8 | Provided | 100 | Ballast for 400W high-pressure Hg lamp | 80 | 4800 | 36.0 | 12.4 |
| | Example 10 | 61 | | 1.89 | 3.0 | Provided | 99 | Ballast for 400W high-pressure Hg lamp | 85 | 4100 | 58.0 | 9.60 |
| | Example 11 | 63 | 4.52 | 0.9 | 7.9 | Provided | 97 | Same | 92 | 4400 | 57.0 | 10.0 |

EXAMPLE 10

A 400 W metal vapor discharge lamp was completed according to the method of Example 8 above, except that the fluorescent layer formed on the inside wall of the outer jacket 1 was only the phosphor of yttrium vanadate activated by trivalent europium. This metal vapor discharge lamp had a starting voltage of 99 V, and could be operated by a ballast for a 400 W high-pressure mercury vapor discharge lamp. It had a color temperature of 4100° K., and a general color rendering index of Ra 85 which is a high color-rendition level, a luminous efficacy of 58 lm/W, and a wall loading of an arc tube of 9.60 W/cm².

EXAMPLE 11

A 400 W metal vapor discharge lamp was completed according to the method of Example 8 above, except that the arc tube 4 was a quartz tube having an inside diameter of 19.5 mm and a distance between electrodes 6 and 7 of 65 mm, and that, after enclosing 63 mg (3.0 mg/cc) mercury, 0.90 mg cadmium and 4.52 mg zinc (total enclosed content of cadmium and zinc was 7.9 weight percent), and then enclosing 20 torr argon gas in the arc tube, the tube was sealed to complete an arc tube having a power input of 400 W. Moreover, fluorescent layer 3 was formed by applying only the yttrium phosphate-vanadate phosphor activated by trivalent europium to the inside wall of the outer jacket 1, and by baking the phosphor. This metal vapor discharge lamp had a starting voltage of 97 V, and could be operated by a ballast for a 400 W high-pressure mercury vapor discharge lamp. It had a color temperature of 4400° K., and a general color rendering index of Ra 92 which is a high color-rendition level, a luminous efficacy of 57 lm/W, and a wall loading of the arc tube of 10.0 W/cm². Table 2 shows the lamp characteristics of the above example lamps as well as those of a conventional high pressure mercury lamp, a fluorescent high-pres- Table 2 clearly shows that all the metal vapor discharge lamps of the examples in the table embodying the present invention can be operated by a ballast for high-pressure mercury vapor discharge lamps, and moreover, that they have a substantially enhanced color-rendering property level as compared with the conventional lamps including the high-pressure mercury lamp, the fluorescent high-pressure mercury lamp, an experimental cadmium-enclosed high-pressure mercury lamp, and an experimental zinc-encloded high-pressure mercury lamp.

The spectral distribution of FIG. 3 for a cadmium-enclosed high-pressure mercury vapor discharge lamp can be compared with that in FIG. 10 for the lamp of Example 8. The lamp of Example 8 can subdue the intensity of the line spectrum from cadmium, to such a low level that the wall loading of the arc tube can be limited to a low level, and the load level for all the exemplary embodiments in this table are therfore within the range of 9–12.5 W/cm², which is roughly the same level as that of the conventional high-pressure mercury lamps (7–13 W/cm² in general). This increases the durability of the arc tube 4 to present long-life metal vapor discharge lamps. Next, the requirements for accomplishing the third object of the present invention will be discussed.

Metal vapor discharge lamps having the structure and performing the functions previously described were experimentally fabricated so that their arc tube 4 enclosed 60 mg mercury, Hg, 20 torr argon, Ar, and 0.8 mg cadmium, Cd. Then a number of lamps in the groups of ten were completed after additionally enclosing some iodine in the arc tube in varied amounts in the different groups. On these lamps, and by use of the ballast for ordinary 400 W high-pressure mercury vapor discharge lamps, measurements were made for obtaining the lumen maintenance factor and the starting characteristics as functions of burning hours, as shown in Table 3.

In this table, the lumen maintenance factor is an average of ten lamps, symbol "x" means that at least one of the ten lamps failed to operate because of a broken arc tube, and, in the starting characteristics column, symbol "o" means that the lamps were operated by a ballast for a high-pressure mercury lamp.

TABLE 3

| Added iodine per cc ($\times 10^{-6}$ gr-atom) | Lumen Maintenance Factor 1,000 Hr | 5,000 Hr | 10,000 Hr | Starting characteristic (200V power source) |
|---|---|---|---|---|
| 0 | 77 | x | x | o |
| 0.01 | 78 | x | x | o |
| 0.03 | 81 | 53 | x | o |
| 0.05 | 83 | 66 | 62 | o |
| 0.1 | 86 | 75 | 70 | o |
| 0.5 | 87 | 76 | 73 | o |
| 0.8 | 87 | 76 | 73 | o |
| 1.0 | | | | x |
| 1.5 | | | | x |
| 2.0 | | | | x |

Table 3 indicates that enclosed iodine reduces the failures occurring during the lifetime of a discharge lamp. It also shows that, if the enclosed content of iodine exceeds $0.8\times10^{-6}$ gr-atom per cubic centimeter of the inner volume of an arc tube, the lamp cannot be operated by the ballast used in ordinary high-pressure mercury vapor discharge lamps. When the content of iodine exceeds $0.7\times10^{-6}$ gr-atom, excessive increase of metal vapor pressure intensifies a blue-green line spectrum which is specific to cadmium (or zinc) vapor discharge with the result that the color-rendering property deteriorates. For this reason, the enclosed content of iodine must be no more than $0.7\times10^{-6}$ gr-atom. The same tendency was observed when bromine and halogens other than iodine are enclosed.

Some specific examples embodying the means to accomplish the third object of the present invention are described below.

EXAMPLE 12

Figure 12:
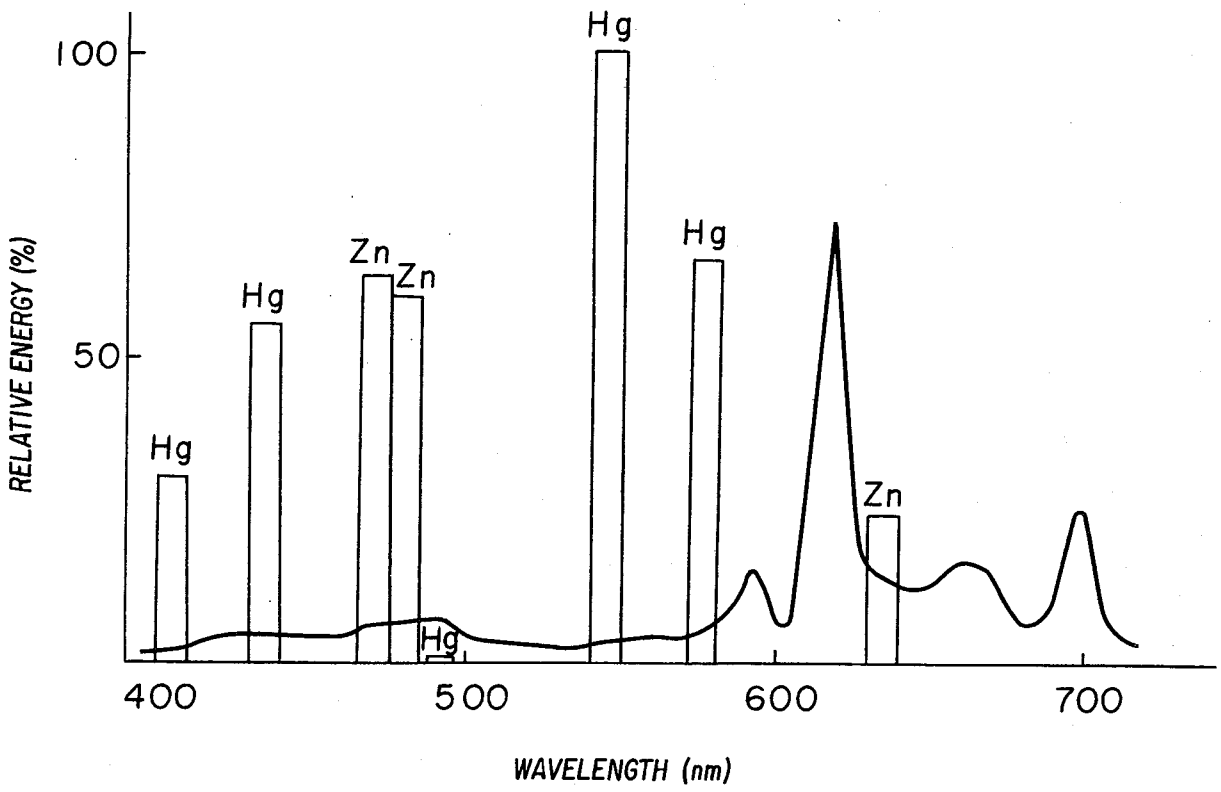
FIGS. 12 and 13 illustrate the spectral distribution of the discharge lamps in Examples 10 and 11, respectively, embodying the present invention.

A 100 W metal vapor discharge lamp having the structure shown in FIG. 4 was completed as follows: An arc tube 4 having a power input of 100 W was made by preparing a quartz tube having an inside diameter of 9.2 mm and a distance between electrodes 6 and 7 of 28 mm, then enclosing in the tube 16.7 mg mercury and 1.0 mg zinc, supplemented by $0.08\times10^{-6}$ gr-atom/cc iodine. Argon was then enclosed at a pressure of 35 torr and then the tube was finally sealed. The inside wall of the outer jacket 1 is coated with a fluorescent layer 3 comprising a mixture of 70 weight-percent yttrium phosphate-vanadate phosphor activated by trivalent europium and 30 weight-percent magnesium fluoro-germanate phosphor activated by tetravalent manganese, and by baking the mixture. Ten metal vapor discharge lamps fabricated in this manner were operated by a choke-type ballast having a rated voltage of 200 V for 100 W high-pressure mercury vapor discharge lamps. All of the ten lamps nearly uniformly showed that their starting voltage was 145 V, which is somewhat higher than the 130 V for the conventional mercury lamps, but is "below the 180 V" specified by JIS (JIS-C-7604-1970) as the maximum limit. They could therefore be operated by a ballast for the high-pressure mercury lamp. The average records of the ten lamps, as observed then, were a color temperature of 4800° K., a general color rendering index Ra of 94, which is a very high color-rendition level, a luminous efficacy of 40 lm/W, and a wall loading of the arc tube of 12.4 W/cm$^2$. Burning test results showed that all the discharge lamps experienced no broken arc tube during and even after 10,000 burning hours, and that almost no blackening of the arc tube wall was observed. This is reflected by a lumen maintenance factor of 68.7 percent on an average of the ten lamps after burning 10,000 hours. For comparison, another burning test was performed after fabricating ten metal vapor discharge lamps according to the specifications of the above-mentioned exemplary embodiment lamps, except that entirely no iodine was enclosed in the lamps, and the result was that, after 5,000 burning hours, five out of the ten lamps were found to be impossible to operate because the arc tubes had cracked, and after only 2,000 burning hours the average luimen maintenance factor was 69 percent for the ten lamps, some of the lamps showing marked blackening of arc tube wall. FIG. 12 illustrates the spectral distribution of this example. The line spectrum symbols Hg and Zn in the figure represent the line spectra of mercury (Hg) and zinc (Zn) vapors, respectively.

EXAMPLE 13

Figure 13:
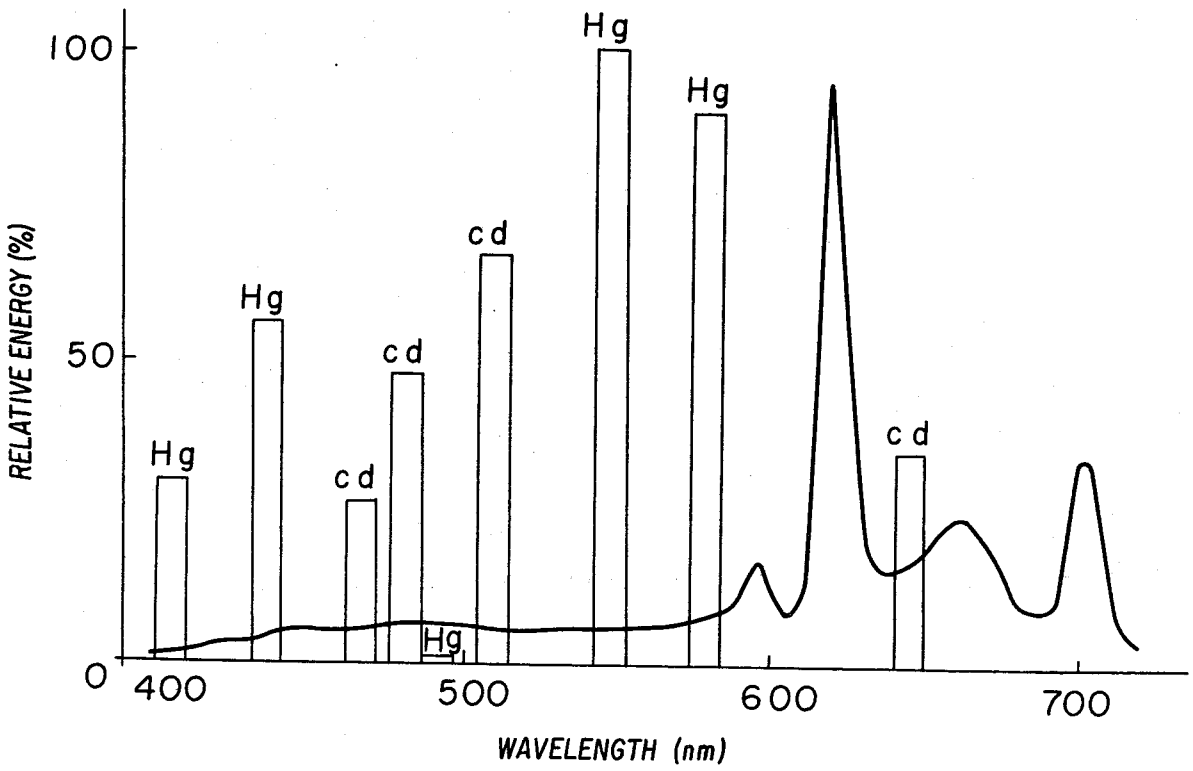

An arc tube 4 was prepared by providing a quartz tube having an inside diameter of 19.5 mm, and a distance between the electrodes 6 and 7 of 70 mm, with 59.0 mg of mercury and 7.0 mg of cadmium, supplemented by $0.1\times10^{-6}$ gr-atom/m iodine. Argon is then enclosed in the tube at a pressure of 20 torr and the tube is sealed, finally sealing the arc tube thereby obtaining an arc tube having a power input of 400 W. The inside wall of the outer jacket 1 was covered by the fluorescent layer 3 comprising a mixture of 70 weight percent of yttrium phosphate-vanadate phosphate activated by trivalent europium, and 30-weight percent of magnesium fluoro-germanate phosphor activated by tetravalent manganese, and the layer was baked. The arc tube 4 was placed in the outer jacket 1, and the bulb was sealed and deaerated to complete the 400 W metal vapor discharge lamp having a construction shown in FIG. 4. The ten metal vapor discharge lamps, fabricated in this manner were operated by a choke-type ballast having a rated voltage of 200 V for 400 W high-pressure mercury lamps. All of the ten lamps nearly uniformly showed that their firing potential was 150 V, which is somewhat higher than the 130 V for the conventional mercury lamps, but is "below the 180 V" specified by JIS as the maximum limit. They could therefore be operated by a ballast for high-pressure mercury lamps. The average records of the ten lamps, as then observed, were a color temperature of 4300° K., a general color rendering index of Ra 95 which is a high color-rendition level, a luminous efficacy of 58 lm/W, and a wall loading of the arc tube of 9.33 W/cm$^2$. Burning test results showed that all the discharge lamps experienced no broken arc tube during and even after 10,000 burning hours, and that almost no blackening of the arc tube wall was observed. This is reflected by a lumen maintenance factor, which was 70.5 percent on the average of the ten lamps after burning 10,000 hours. For comparison, another burning test was performed after fabricating ten metal vapor discharge lamps after the method described in Example 13 above, with each of the lamps not containing any iodine. The result was that, after 5,000 burning hours four out of the ten lamps were found to be impossible to operate as their arc tubes were cracked, and after only 2,500 burning hours the ten lamps exhibited an average lumen maintenance factor of 71 percent with some of the lamps showing marked blackening of the arc tube walls. FIG. 13 illustrates the spectral distribution of the lamp Example 13. The line spectrum symbols Hg and Cd in the figure represent the spectral lines of mercury (Hg) and cadmium (Cd) vapor, respectively.

EXAMPLE 14

Ten 400 W metal vapor discharge lamps were fabricated according to the method of Example 13 above, except that the fluorescent layer formed on the inside wall of the outer jacket 1 contained only yttrium vanadate phosphor activated by trivalent europium. All of the ten lamps nearly uniformly showed that their starting voltage was 150 V, and they could therefore be operated by a ballast for 400 W high-pressure mercury lamps. The lamps showed a color temperature of 4100° K., a general color rendering index of Ra 90, which is a high color rendition level, a luminous efficacy of 58.5 lm/W, and a loading on the walls of an arc tube of 9.33 W/cm$^2$. The burning test results were similar to those from Example 13 above.

EXAMPLE 15

Ten 400 W metal vapor discharge lamps were fabricated according to the method of Example 13 above, except that the amount of mercury enclosed in the arc tube 4 was 59.0 mg, that of zinc was 2.9 mg, that of cadmium was 1.5 mg, and that of iodine was $0.2\times10^{-6}$ gr-atom/cc. All of the ten lamps nearly uniformly showed that their starting voltage was 160 V, and they could therefore be operated by a ballast for 400 W high-pressure mercury lamps. The lamps showed a color temperature of 4200° K., a general color rendering index of Ra 89, which is a high color rendition level, a luminous efficacy of 57.5 lm/W, and a loading on the walls of an arc tube of 9.33 W/cm$^2$. The burning test results showed that all the discharge lamps experienced no broken arc tubes during and even after 10,000 burning hours, and that almost no blackening of the arc tube walls was observed. This is reflected by an observed lumen maintenance factor of 72.3 percent on the average of the ten lamps after burning 10,000 hours. For comparison, another burning test was performed after fabricating ten metal vapor discharge lamps according to the specification for the case mentioned in Example 13, and the result was that, after 5,000 burning hours, four out of the ten lamps were found impossible to operate because their arc tubes were cracked and, after only 2,800 burning hours, an average lumen maintenance factor of 73 percent was observed for the ten lamps, some of the lamps showing marked blackening on the arc tube walls.

Table 4 shows the lamp characteristics of all of the lamps of the above example, as well as those of a conventional high-pressure mercury lamp, a fluorescent high-pressure mercury lamp, an experiemental high-pressure mercury lamp with enclosed cadmium, and an experimental high-pressure mercury lamp with enclosed zinc.

TABLE 4

| | | Metal enclosed | | | | Iodine | Starting Voltage | | | Color | Luminous | Wall leading of |
|---|---|---|---|---|---|---|---|---|---|---|---|---|
| | | Hg (mg) | Zn (mg) | Cd (mg) | Phosphor | content (gr-atom/cc) | (V) | Ballast type | Ra | temp. (°K.) | efficacy (lm/W) | Arc tube (W/cm$^2$) |
| Conventional lamp | High-pressure Hg vapor discharge lamp | 70 | | | None | | 130 | Ballast for 400W high-pressure Hg lamp | 23 | 5900 | 52.5 | 9.33 |
| | Fluorescent high-pressure Hg lamp | 70 | | | Provided | | 130 | Same | 53 | 4100 | 60.0 | 9.33 |
| | Cd-enclosed high-pressure Hg lamp (trially fabricated) | 60 | | 10 | None | | 100 | Same | 62 | 7250 | 42.5 | 17.8 |
| | Zn-enclosed high-pressure Hg lamp (trically fabricated) | 65 | 8 | | None | | 100 | Same | 49 | 6500 | 38.0 | 19.2 |
| Example embodying this invention | Example 12 | 16.7 1 | 1.0 | | Provided | $0.08\times10^{-6}$ | 145 | Ballast for 100W high-pressure Hg lamp | 80 | 4800 | 40 | 12.4 |
| | Example 13 | 59.0 | | 7.0 | Provided | $0.1\times10^{-6}$ | 150 | Ballast for 400 W high-pressure Hg lamp | 95 | 4300 | 58 | 9.33 |
| | Example 14 | 59.0 | | 7.0 | Provided | $0.1\times10^{-6}$ | 150 | Same | 85 | 4100 | 58.5 | 9.33 |
| | Example 15 | 59.0 | 2.9 | 1.5 | Provided | $0.2\times10^{-6}$ | 160 | Same | 89 | 4200 | 57.5 | 9.33 |

Table 4 clearly shows that all the metal vapor discharge lamps of the examples in the table embodying the present invention can be operated by a ballast for high-pressure mercury vapor discharge lamps, and that, as a result of multiplied effects between the vapor discharge of cadmium or zinc and the fluorescent layer, they have a substantially enhanced color-rendering property level, as compared with conventional lamps including a high-pressure mercury lamp, a fluorescent high-pressure mercury lamp, an experimental cadmium-enclosed high-pressure mercury lamp, and an experimental zinc-enclosed high-pressure mercury lamp.

With regard to the arc tube load, the spectral distribution in FIG. 3 for a cadmium-enclosed high-pressure mercury vapor discharge lamp can be compared with that of the lamp of Example 13 as shown in FIG. 13. The lamp subdues the intensity of the line spectrum from cadmium to such a low level, with the enclosed halogen enhancing the vapor pressure of the cadmium to a high level, that the loading on the wall of the arc tube can be limited to a low level, and the load level for all the exemplary embodiments in this table are therefore within the range of 9–12.5 W/cm$^2$, which is roughly the same level as that of the conventional high-pressure mercury lamps (7–13 W/cm$^2$). Moreover, the enclosed halogen suppresses the generation of cadmium oxide or zinc oxide. This increases the durability of the arc tube 4 which in turn yields long-life metal vapor discharge lamps. For instance, the durable life of metal vapor discharge lamps embodied in Example 13, as observed on the average of ten experimental lamps, was 12,000 hours, which is equivalent to the approximately 12,000 hours for the conventional high-pressure mercury lamp.

The following is a discussion of the requirements of the fourth objective of the present invention. As for the metal vapor discharge lamps having the construction described above, factor-varying studies were conducted on lamps having a wall loading of the arc tube of We "(WL/$\pi$DL)"(unit: W/cm$^2$) and having enclosed contents of mercury, cadmium and zinc ($m_{Hg}$, $m_{Cd}$ and $M_{Zn}$, respectively) where Wc is the electric power input in W, D is the inside diameter of the arc tube 4 in cm, L is the distance between the electrodes in cm, and $m_{Hg}$, $m_{Cd}$ and $m_{Zn}$ are enclosed contents per unit inner volume of the arc tube 4 for the respective metal in mg/cc.

Figure 14:
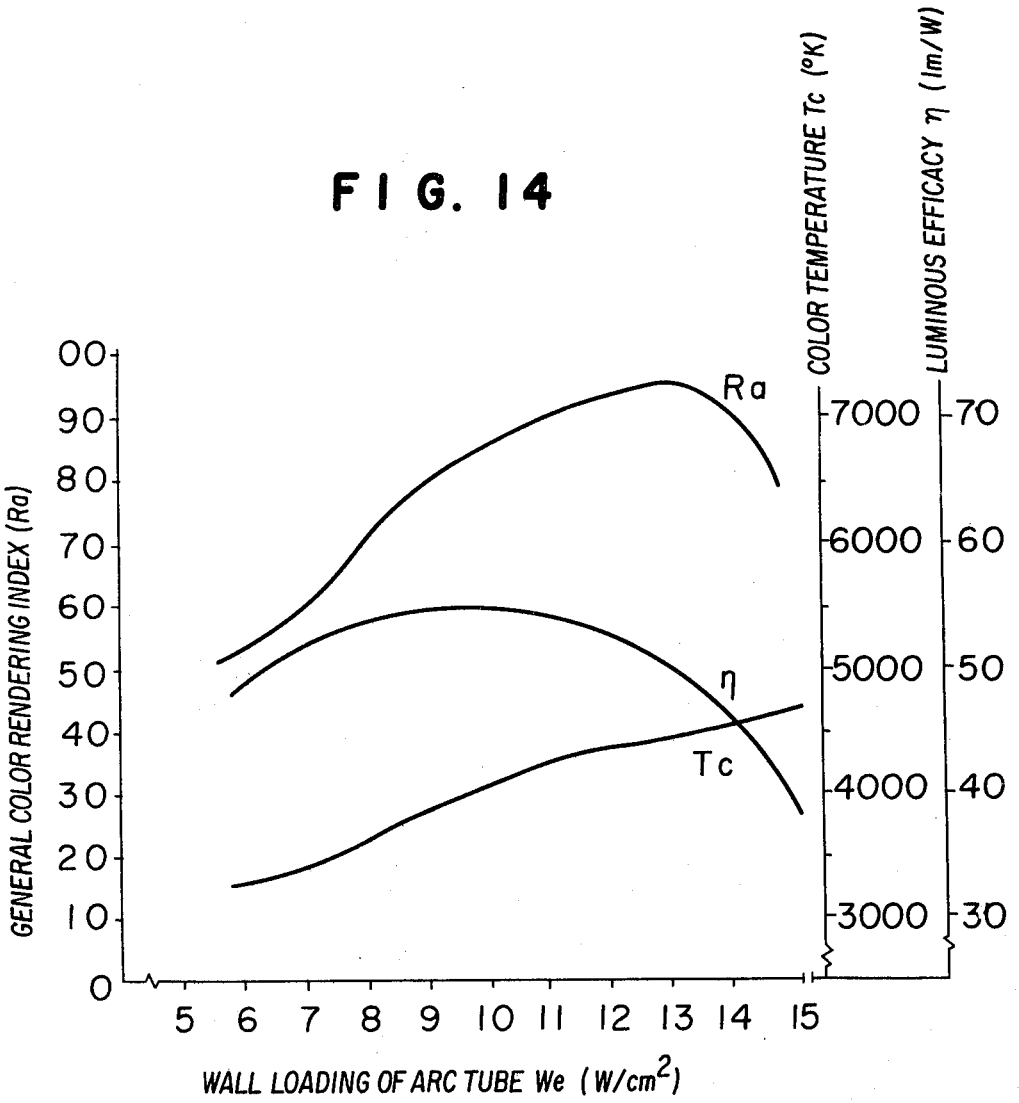
FIG. 14 illustrates the general color rendering index Ra, color temperature Tc, and luminous efficacy $\eta$, as a function of cadmium content, when cadmium is enclosed in the arc tube.

FIG. 14 is a diagram illustrating the general color rendering index Ra, color temperature Tc°K, and luminous efficacy, $\eta$ lm/W as a function of the wall loading of an arc tube of a large member of lamps within the scope of the present invention with all of them having an arc tube inside diameter D of 1.95 cm, a cadmium content $m_{Cd}$ of 0.04 mg/cc with no zinc content $m_{Zn}$. The distance L between the electrodes of the lamps was varied entailing a change in the wall loading of the arc tube $W_e$, and still all of the lamps equally maintained a lamp voltage of 130 V, a lamp current of 3.3 A, and a lamp power of 400 W by adjusting the mercury content $m_{Hg}$. The lamps were operated by the ballast for 400 W high-pressure mercury lamps. FIG. 14 clearly indicates that, if the wall loading of an arc tube We exceeds 7 W/cm$^2$, the general color rendering index Ra remarkably rises: when We is approximately 13 W/cm$^2$, Ra reaches the peak of 95, and when We exceeds the point, Ra drops. This leads to the conclusion that the wall loading of the arc tube should be between 7 and 14 W/cm$^2$. The reasons are considered to be as follows: If the wall loading of the arc tube We is below 7 W/cm$^2$, the coolest temperature point on the tube wall will be too low to secure sufficient vapor pressure of cadmium and make the cadmium luminesce, which means that the lamp will fail to exhibit an improved general color rendering index Ra. If the wall loading of the art tube exceeds 14 W/cm$^2$, cadmium will luminesce too intensively and cause a drop of the general color rendering index Ra and that of luminous efficacy $\eta$, and at the same time such a heavy wall load may crack the quartz arc tube resulting in shortened life of the tube.

Figure 15:
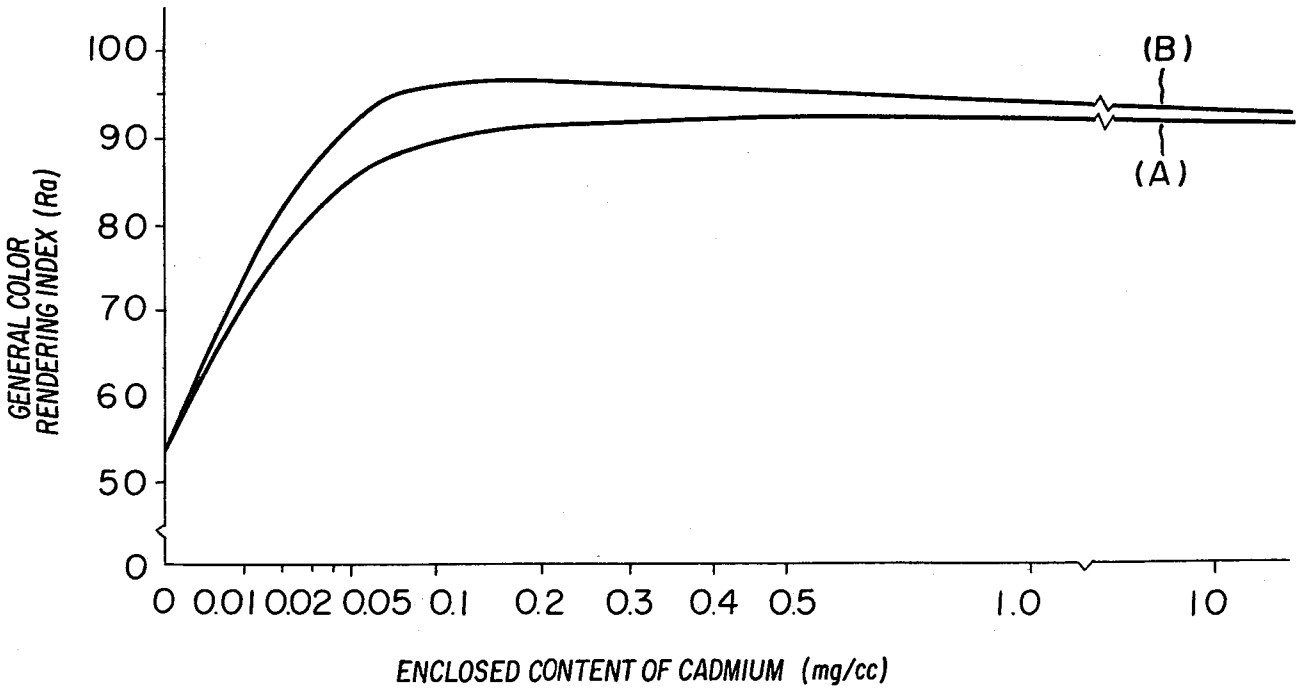
FIG. 15 illustrates the general color-rendering index Ra, as a function of cadmium content when cadmium is enclosed in the arc tube.

FIG. 15 illustrates the general color rendering index Ra as a function of the enclosed cadmium content $m_{Cd}$. FIG. 15A illustrates the fluctuation of the general color rendering index Ra, as a function of varying cadmium content when the inside diameter of the arc tube was 1.95 cm, the distance L between electrodes was 6.9 cm, the enclosed content of zinc was zero, and some adjustments were made so that the wall loading of the arc tube We was 9.46 W/cm$^2$, the tube power input $W_L$ was 400 W, and when the lamp could be operated by the ballast for a 400 W mercury lamp. FIG. 15B illustrates the fluctuation of the general color rendering index Ra, as a function of varying cadmium content when the inside diameter of the arc tube D was 1.95 cm, the distance L between the electrodes was 5.5 cm, the enclosed content of zinc was zero, and some adjustments were made so that the wall loading of the arc tube We was 11.87 W/cm$^2$ and the arc tube power input $W_L$ was 400 W. The FIG. 15 clearly indicates that, when the enclosed content of cadmium is approximately between 0.05 and 0.1 mg/cc the general color rendering index Ra becomes almost saturated, and Ra remains almost constant until the cadmium content rises to approximately 10 mg/cc. This leads to the conclusion that the cadmium content should be between 0.002 and 2 mg/cc in order to attain a high color-rendering property level. If the enclosed content of cadmium is below 0.002 mg/cc, some of the added metal in the lamp mechanism may be oxidized and the lamp will fail to luminescence, resulting in deterioration of color rendition. If the content exceeds 2 mg/cc, some cadmium may deposit unevaporated at and around the coolest point in the arc tube 4, most often intercepting the light emitted from the arc discharge, and shortcircuiting the starting electrode 9 to the main electrode 7 which results in failure of the lamp to start up. The content of mercury enclosed $m_{Hg}$ in the arc tube 4 was required to be between 0.5 mg and 20 mg per unit volume of the arc tube 4. If the amount of mercury enclosed $m_{Hg}$ is below 0.5 mg/cc, the mercury vapor pressure will be so low that in some cases elongation of the arc tube 4 will be so low that in some cases elongation of the arc tube 4 will be required to secure the desired lamp voltage, which results in deterioration of efficiency thereby rendering the lamp useless. If the amount of mercury exceeds 20 mg/cc, the pressure of mercury vapor will climb so high that an even higher pressure level will be required for the added metal. This will raise the load on the arc tube wall more than the normal requirement of, viz. up to 14 W/cm$^2$ or more, and may result in cracking and other problems of the arc tube 4.

It was clarified that if the color-rendering property is to be enhanced substantially and stable lamp characteristics are to be secured for the metal vapor discharge lamp having an outer jacket, the inside wall of which is covered with a fluorescent layer comprising a red emitting phosphor or phosphors whose emission peak is in a wavelength range of 610–630 nm and whose luminescence forms a line and also having an arc tube placed in said outer jacket and enclosing zinc and/or cadmium in addition to mercury as the principal luminescing contents, then the factors of the lamp are required to be so combined as to satisfy the following three formulae:

$$7 \leqq \frac{W_L}{\pi DL} \leqq 14$$

$$0.002 \leqq m_{Cd} + m_{Zn} \leqq 2, (m_{Cd} \geqq 0, m_{Zn} \geqq 0)$$

$$0.5 \leqq m_{Hg} \leqq 20$$

where,

D: inside diameter of arc tube, cm

L: distance between electrodes, cm $W_L$: power input, W $m_{Hg}$: enclosed content of mercury per unit tube volume, mg/cc $m_{Cd}$: enclosed content of cadmium per unit tube volume, mg/cc $m_{Zn}$: enclosed content of zinc per unit tube volume, mg/cc It is to be noted that a metal vapor discharge lamp having such a structure does not contain so highly negatively charged halogens as the metal halogen lamp does, and requires only a starting voltage at a level similar to the high-pressure mercury lamp. A ballast for high-pressure mercury lamps can therefore operate this type of lamp.

Some conventional cases are described below for comparison with the exemplary embodiments of the present invention.

CONVENTIONAL EXAMPLE A

A 400 W fluorescent high-pressure mercury vapor discharge lamp having a structure shown in FIG. 4 was fabricated. This lamp had an arc tube diameter D of 1.95 cm, a distance L between electrodes of 6.9 cm with the arc tube 4 containing 3.09 mg/cc of enclosed mercury. The lamp had an outer jacket 1 whose inside wall was coated with 70 weight-percent of yttrium vanadate phosphor activated by trivalent europium, and 30 weight-percent magnesium fluoro-germanate phosphor activated by tetravalent manganese. This lamp showed a low general color rendering index of Ra 53.

CONVENTIONAL EXAMPLE B

A 400 W mercury lamp having the same structure as the lamp of Example A above was fabricated, except that the arc tube 4 enclosed 2.72 mg/cc mercury and 0.04 mg/cc cadmium, and except that the inside wall of the outer jacket 1 was not coated with any phosphor 3. This lamp showed a low general color rendering index of Ra 47.3, and a high color temperature of 6500°K, emitting undesirable pale blue light.

EXAMPLE 16

Figure 16:
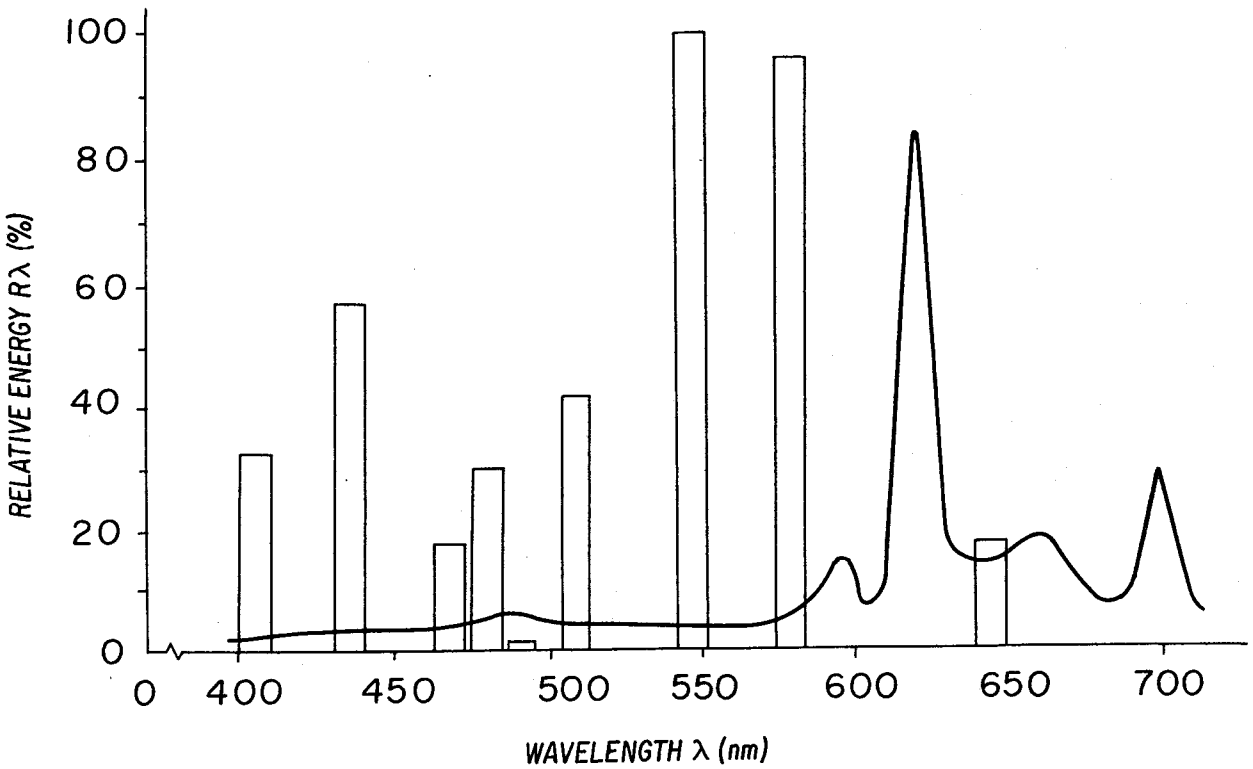
FIGS. 16 and 17 illustrate the spectral distribution in Examples 16 and 17, respectively, embodying the present invention.

A 400 W metal vapor discharge lamp having the structure shown in FIG. 4 was fabricated. This lamp had an arc tube diameter D of 1.95 cm, and a distance L between the electrodes of 6.9 cm, and the arc tube 4 enclosed 2.72 mg/cc mercury and 0.04 mg/cc cadmium. The lamp had an outer jacket 1 whose inside wall was coated with the fluorescent layer 3 comprising 70 weight-percent of yttrium vanadate phosphor activated by trivalent europium, and 30 weight-percent of magnesium fluoro-germanate phosphor activated by tetravalent manganese. This lamp showed a general color rendering index of Ra 83 which is a high color rendition level. FIG. 16 illustrates the spectral distribution of this metal vapor discharge lamp.

EXAMPLE 17

Figure 17:
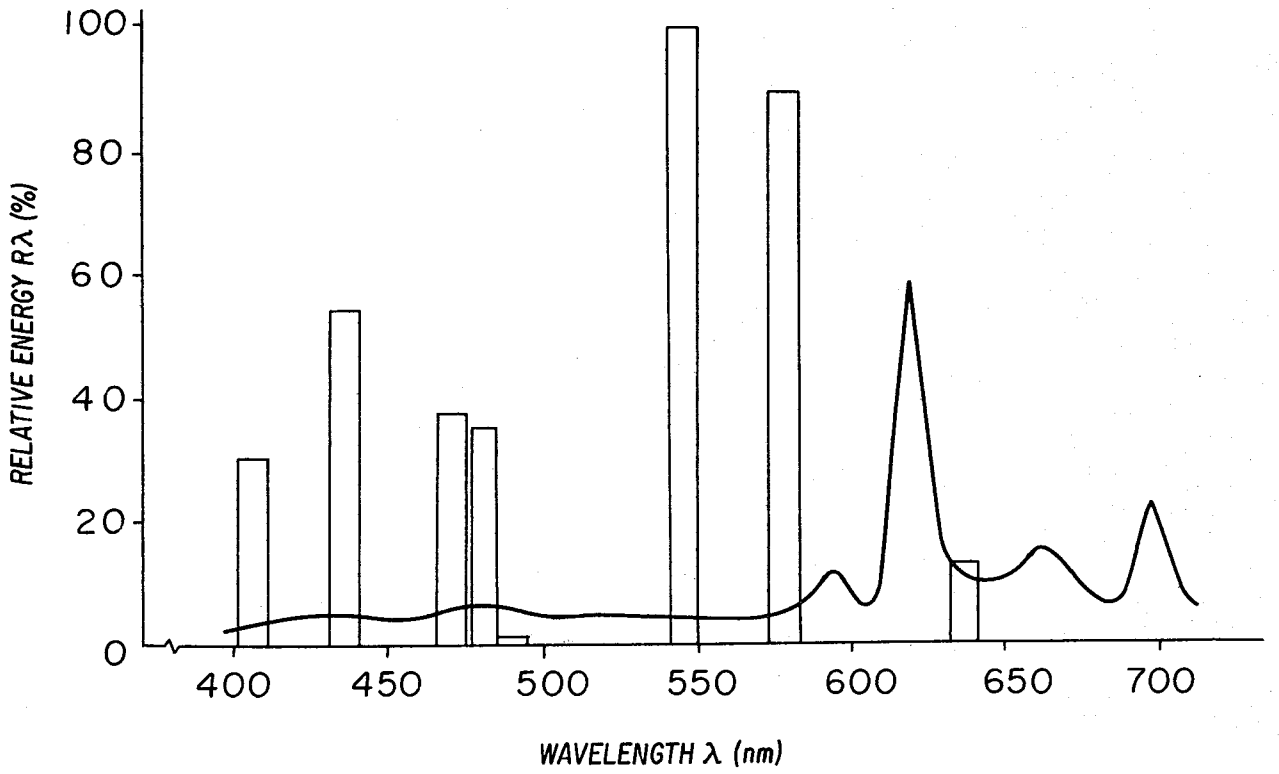

A 400 W metal vapor discharge lamp was fabricated, having the same structure as that of the Example 16 lamp above, except that the distance L between the electrodes was 5.5 cm, and except that the arc tube 4 enclosed 4.09 mg/cc mercury and 0.3 mg/cc zinc. This lamp showed a general color rendering index of Ra 71 which is a high color rendition level. FIG. 17 illustrates the spectral distribution of this metal vapor discharge lamp.

EXAMPLE 18

A 100 W metal vapor discharge lamp having the structure shown in FIG. 4 was fabricated. This lamp had an arc tube diameter D of 0.92 cm, and a distance L between the electrodes of 3.1 cm, and the arc tube 4 enclosed 5.63 mg/cc mercury and 0.08 mg/cc cadmium. The lamp had an outer jacket 1 whose inside wall was coated with fluorescent layer 3 comprising 70 weight-percent yttrium vanadate phosphor activated by trivalent europium, and 30 weight-percent of magnesium fluoro-germanate phosphor activated by tetravalent manganese. This lamp showed a general color rendering index of Ra 91.1.

EXAMPLE 19

A 40 W metal vapor discharge lamp having the structure shown in FIG. 4 was fabricated. This lamp had an arc tube diameter D of 0.72 cm, and a distance L between the electrodes of 1.65 cm, and the arc tube 4 enclosed 6.91 mg/cc mercury and 0.10 mg/cc cadmium. The lamp had an outer jacket 1 whose inside wall was coated with fluorescent layer 3 comprising 70 weight-percent of yttrium vanadate phosphor activated by trivalent europium, and 30 weight-percent of magnesium fluoro-germanate phosphor activated by manganese. This lamp showed a general color rendering index of Ra 80.6 which is a high color rendition level.

EXAMPLE 20

A 40 W metal vapor discharge lamp having the same structure as that of the lamp of Example 19 above was fabricated except that the distance L between the electrodes was 1.45 cm and the arc tube 4 enclosed 8.9 mg/cc mercury. This lamp showed a general color rendering index of Ra 71.5 which is a high color-rendition level.

All the Examples from 16 through 20 above embodying the present invention could be operated by the ballast for high-pressure mercury vapor discharge lamps. Table 5 tabulates these exemplary embodiments as well as the examples of conventional lamps.

TABLE 5

| | Lamp power input $W_L$ (W) | Shape of arc tube: Inside dia. D (cm) | Shape of arc tube: Distance between electrodes L (cm) | Wall Loading of arc tube (mg/cc) | Hg enlosed content $m_{Hg}$ (mg/cc) | Added metals enclosed content (mg/cc) | Electrical characteristics: Lamp voltage $V_L$ (V) | Electrical characteristics: Lamp current $I_L$ (A) | General color render-index Ra | Color temp. $T_L$ (°K.) | Luminous flux $\phi$ (lm) | Luminous efficacy $\eta$ (l m/W) | Starting voltage $V_I$ |
|---|---|---|---|---|---|---|---|---|---|---|---|---|---|
| Conventional Lamp | | | | | | | | | | | | | |
| Ex. A | 400 | 1.95 | 6.9 | 9.46 | 3.09 | 0 | 130 | 3.25 | 53 | 3300 | 24000 | 60 | 180 |
| Ex. B | 400 | 1.95 | 6.9 | 9.46 | 2.72 | $m_{Cd}$ | 129 | 3.25 | 48 | 6500 | 18900 | 47.3 | 110 |

TABLE 5-continued

| | Lamp power input $W_L$ (W) | Shape of arc tube: Inside dia. D (cm) | Shape of arc tube: Distance between electrodes L (cm) | Wall Loading of arc tube (mg/cc) | Hg enlosed content $m_{Hg}$ (mg/cc) | Added metals enclosed content (mg/cc) | Electrical characteristics: Lamp voltage $V_L$ (V) | Electrical characteristics: Lamp current $I_L$ (A) | General color render-index Ra | Color temp. $T_L$ (°K.) | Luminous flux $\phi$ (lm) | Luminous efficacy $\eta$ (l m/W) | Starting voltage $V_I$ |
|---|---|---|---|---|---|---|---|---|---|---|---|---|---|
| | | | | | | 0.04 | | | | | | | |
| Example embodying this invention | | | | | | | | | | | | | |
| Ex. 16 | 400 | 1.95 | 6.9 | 9.46 | 2.72 | $m_{Cd}$ 0.04 | 133.5 | 3.20 | 83 | 4100 | 22300 | 55.8 | 110 |
| Ex. 17 | 400 | 1.95 | 5.5 | 11.8 | 4.09 | $m_{Zn}$ 0.3 | 133.5 | 3.20 | 7.1 | 4400 | 19600 | 49.0 | 110 |
| Ex. 18 | 100 | 0.92 | 3.1 | 11.2 | 5.63 | $m_{Cd}$ 0.08 | 119.5 | 0.94 | 91.1 | 4700 | 3700 | 37.0 | 105 |
| Ex. 19 | 40 | 0.72 | 1.65 | 10.7 | 6.91 | $m_{Cd}$ 0.10 | 99 | 0.495 | 80.6 | 4600 | 1260 | 31.5 | 110 |
| Ex. 20 | 40 | 0.72 | 1.45 | 12.2 | 8.9 | $m_{Cd}$ 0.010 | 105 | 0.43 | 71.5 | 4400 | 1350 | 33.7 | 110 |

It is to be noted that in the cases of the metal vapor discharge lamps shown in the examples above, good results were obtained when traces of halogens such as iodine or bromine were enclosed. For example, halogen of $0.7\times10^{-6}$ gr-atom or less per cubic centimeter of the inner volume of the arc tube 4 hampered some cadmium or zinc oxides from adhering to and reacting with the quartz of the tube. Such oxides tend to be produced by the presence of oxygen or moisture exiting in the arc tube. This function of the halogen prevents early blackening of the arc tube and cracking of the tube. The amount of the enclosed halogen is so small that the starting voltage still remains rather low to allow ignition by the ballast for high-pressure mercury lamps. Moreover, no reaction of the halogen with the electron-emitting materials applied to the electrodes was observed.

INDUSTRIAL APPLICABILITY

The metal vapor discharge lamp of this invention is applicable for interior lighting purposes because of its high color-rendition level.

We claim:

1. A metal vapor discharge lamp having an outer jacket, the inside wall of which is covered by a fluorescent layer comprising at least one red emitting phosphor whose emission peak is in a wavelength range of 610–630 nm and whose luminescence forms a line, said lamp containing an arc tube within the confines of said outer jacket which encloses zinc and/or cadmium in addition to mercury as the main luminous contents, the total content of zinc and/or cadmium taken relative to the total amount of enclosed metal including mercury being between 0.1 and 50 weight-percent.

2. The lamp of claim 1, wherein the amount of said enclosed mercury is between 0.5 and 20 mg per cubic centimeter of the inner volume of the arc tube.

3. The lamp of claim 1 or 2, wherein said fluorescent layer comprises a mixture of phosphors of at least 50 weight-percent of a red emitting phosphor with the remainder being a magnesium fluoro-germanate phosphor activated by tetravalent manganese.

4. The lamp of claim 1 or 2, wherein said red emitting phosphor is yttrium vanadate activated by trivalent europium, wherein any of the metal elements in the crystal matrix of the vanadate phosphor are replaceable by at least one element selected from the group consisting of phosphorus, arsenic, boron, silicon, gadolinium, zinc, cadmium, terbium and bismuth.

5. A metal vapor discharge lamp having an outer jacket, the inside wall of which is covered by a fluorescent layer comprising at least one red emitting phosphor whose emission peak is in the wavelength range of 610–630 nm and whose luminescence forms a line, said lamp containing an arc tube within the confines of said outer jacket which encloses zinc and/or cadmium in addition to mercury, as the main luminous contents, the amount of zinc and/or cadmium relative to the total amount of enclosed metal including mercury being between 0.1 and 50 weight percent, and said arc tube enclosing a halogen content of $0.7\times10^{-6}$ gr-atom or less per cubic centimeter of the inner volume of the arc tube.

6. The lamp of claim 5, wherein said fluorescent layer comprises a mixture of phosphors of at least 50 weight-percent of a red emitting phosphor with the remainder being magnesium fluoro-germanate phosphor activated by tetravalent manganese.

7. The lamp of claim 5 or 6, wherein said red emitting phosphor is yttrium vanadate activated by trivalent europium, wherein any of the metal elements in the crystal matrix of said vanadate are replaceable by at least one element selected from the group consisting of phosphorus, arsenic, boron, silicon, gadolinium, zinc, cadmium, terbium and bismuth.

8. A metal vapor discharge lamp having an outer jacket, the inside wall of which is covered by a fluorescent layer comprising at least one red emitting phosphor whose emission peak is in a wavelength range or 610–630 nm and whose luminescence forms a line, said lamp containing an arc tube within the confines of said outer jacket which encloses zinc and/or cadmium in addition to mercury as the main luminous components, the total content of zinc and/or cadimum taken relative to the total amount of enclosed metal including mercury being between 0.1 and 50 weight percent, and said lamp fulfilling the requirements expressed by the following three formulae:

$$7 \leqq \frac{W_L}{\pi DL} \leqq 14 \quad (3)$$

-continued $$0.002 \leqq m_{Cd} + m_{Zn} \leqq 2, (0 \leqq m_{Cd}, 0 \leqq m_{Zn}) \quad (2)$$

$$0.5 \leqq m_{Hg} \leqq 20$$

where, $W_L$: power input

D: inner diameter of art tube, cm

L: distance between electrodes, cm $m_{Hg}$, $m_{Cd}$, and $m_{Zn}$: enclosed metal contents of mercury, cadmium and zinc, respectively, per unit volume of arc tube, mg/cc.

9. A metal vapor discharge lamp having an outer jacket, the inside wall of which is covered by a fluorescent layer comprising at least one red emitting phosphor whose emission peak is in a wavelength range or 610–630 nm and whose luminescence forms a line, said lamp containing an arc tube within the confines of said outer jacket which encloses zinc and/or cadmium in addition to mercury as the main luminous components, the total amount of zinc and/or cadmium taken relative to the total amount of enclosed metal including mercury being between 0.1 and 50 weight percent, and said arc tube enclosing an amount of halogen of at most $0.7 \times 10^{-6}$ gr-atom per centimeter of the inner volume of said arc tube; and said lamp fulfilling the requirements expressed by the following three formulae:

$$7 \leqq \frac{W_L}{\pi DL} \leqq 14$$

$$0.002 \leqq m_{Cd} + m_{Zn} \leqq 2, (0 \leqq m_{Cd}, 0 \leqq m_{Zn}) \quad (2)$$

$$0.5 \leqq m_{Hg} \leqq 20$$

where, $W_L$: power input

D: inner diameter of arc tube, cm

L: distance between electrodes, cm $m_{Hg}$, $m_{Cd}$, and $m_{Zn}$: enclosed metal contents of mercury, cadmium and zinc, respectively, per unit volume of arc tube, mg/cc.

* * * * *